United States Patent [19]

Miyoshi et al.

[11] Patent Number: 4,912,026

[45] Date of Patent: Mar. 27, 1990

[54] LIGHT-SENSITIVE SILVER HALIDE PHOTOGRAPHIC MATERIAL FEASIBLE FOR RAPID PROCESSING COMPRISING HIGH BOILING SOLVENT AND GOLD COMPOUNDS

[75] Inventors: Masanobu Miyoshi; Makoto Kajiwara; Kaoru Onodera, all of Odawara; Eiichi Sakamoto, Hino, all of Japan

[73] Assignee: Konishiroku Photo Industry Co., Ltd., Tokyo, Japan

[21] Appl. No.: 328,721

[22] Filed: Mar. 23, 1989

Related U.S. Application Data

[63] Continuation of Ser. No. 79,234, Jul. 29, 1987, abandoned.

[30] Foreign Application Priority Data

Jul. 31, 1986 [JP] Japan ..... 61-180975

[51] Int. Cl.[4] ..... G03C 1/06; G03C 7/26

[52] U.S. Cl. ..... 430/546; 430/551; 430/567; 430/605; 430/607; 430/611; 430/613; 430/621

[58] Field of Search ..... 430/605

[56] References Cited

U.S. PATENT DOCUMENTS

| | | | |
|---|---|---|---|
| 2,843,491 | 7/1958 | Allen et al. | 96/109 |
| 4,163,669 | 8/1979 | Kanada et al. | 96/74 |
| 4,269,927 | 5/1981 | Atwell | 430/604 |
| 4,564,591 | 1/1986 | Tanaka et al. | 430/567 |
| 4,609,618 | 9/1986 | Sasaki et al. | 430/546 |
| 4,617,258 | 10/1986 | Menjo et al. | 430/566 |
| 4,623,616 | 11/1986 | Takada et al. | 430/626 |
| 4,818,671 | 4/1989 | Ohbayashi et al. | 430/550 |

FOREIGN PATENT DOCUMENTS

| | | | |
|---|---|---|---|
| 17148 | 10/1980 | European Pat. Off. | 430/605 |
| 0122125 | 10/1984 | European Pat. Off. . | |
| 0137271 | 4/1985 | European Pat. Off. . | |
| 0208146 | 1/1987 | European Pat. Off. | 430/607 |
| 2032923 | 10/1978 | United Kingdom . | |
| 2041356 | 9/1980 | United Kingdom | 430/611 |

OTHER PUBLICATIONS

Research Disclosure#17643 "Photographic Silver Halide . . . ", 12/78 pp. 22–24.

European Search Report EP No. 87 30 6816 (4 pages).

Vol. 10 No. 15 (P–422) (2072) Jan. 21, 1986 (1 page).

Vol. 10 No. 84 (P–442) (2141) Apr. 3, 1986 (1 page).

*Primary Examiner*—Paul R. Michl

*Assistant Examiner*—Patrick A. Doody

*Attorney, Agent, or Firm*—Jordan B. Bierman

[57] ABSTRACT

A light-sensitive silver halide photographic material having a support with at least one silver halide emulsion layer containing a dye-forming coupler, where the light-sensitive silver halide photographic material is characterized in that at least one of the silver halide emulsion layers contains (i) the dye-forming coupler dispersed with the use of a high boiling organic solvent having a dielectric constant of 6.0 or less, (ii) silver halide grains containing a gold compound and having silver chloride content of 90 mole % or more, and (iii) a compound represented by General Formula (S) shown below. General Formula (S):

where Q is a group of atoms necessary to complete a 5- or 6-membered heterocyclic ring or a 5- or 6-membered ring fused with a benzene ring and M is a hydrogen atom, an alkali metal or an ammonium group.

The light-sensitive material can achieve excellent preservation of the dye image, is feasible for rapid processing, has superior BF contamination resistance and pH variation resistance.

14 Claims, No Drawings

LIGHT-SENSITIVE SILVER HALIDE PHOTOGRAPHIC MATERIAL FEASIBLE FOR RAPID PROCESSING COMPRISING HIGH BOILING SOLVENT AND GOLD COMPOUNDS

This application is a Continuation, of application Ser. No. 079,234, filed Jul. 29, 1987, now abandonded.

FIELD OF THE INVENTION

The present invention relates to a light-sensitive silver halide photographic material, and more particularly, to a light-sensitive silver halide photographic material feasible for rapid processing and also capable of achieving excellent preservation of a dye image formed by the reaction of an oxidized product of a color developing agent with a dye-forming coupler having been contained in the light-sensitive material.

BACKGROUND OF THE INVENTION

A dye image is formed by exposing a light-sensitive silver halide photographic material, followed by color developing, and the dye image obtained is desired to have high fastness to light, heat and humidity. The fastness of a dye image is affected by various factors, and is known to greatly depend on the properties of a dye-forming coupler which forms a dye by reacting with a color developing agent, and of a high boiling organic solvent used for dissolving the dye-forming coupler. However, when the dye-forming coupler is selected, not only it is important for a dye to have the fastness, but also it is essential for the dye to have a desired absorption characteristic for the purpose of color reproduction, and moreover it is desired to have good color development efficiency and good stability in a solvent. Thus, the scope of the selection can not be limitless. For this reason, there is a limit in improving the fastness by selecting the dye-forming coupler. On the other hand, the high boiling solvent used for dissolving the coupler may have important influence to the fastness of a dye, and Japanese Patent Publication Open to Public Inspection (hereinafter referred to as Japanese Patent O.P.I. Publication) No. 205447/1985 discloses that the fastness can be improved by using a high boiling solvent having a given dielectric constant.

However, it was revealed that although the fastness of a dye to be formed may be improved by using the high boiling organic solvent disclosed in the above publication, the color development performance of the dye-forming coupler dissolved therein tends to be lowered.

On the other hand, recent years, in the present photographic field, what have been sought after are light-sensitive silver halide photographic materials that can practice rapid processing, may have high image quality and yet superior processing stability, and can be of low cost. Particularly sought after are light-sensitive silver halide photographic materials that can be processed rapidly.

Namely, it is practiced to continuously process light-sensitive silver halide photographic materials usually in an automatic processing machine installed in every photofinishing laboratory. However, as a part of improvement in services to users, it is desired to finish processing and return products to users in the day the development orders were received, and, nowadays, it is further desired even to return products in several hours after receipt of orders, whereby there is increasing necessity for the rapid processing. Development of the rapid processing is also hastened because a shortened processing time may bring about increase in the production efficiency and a cost decrease may be thereby made possible.

To achieve the rapid processing, there have been made approaches from two aspects, i.e., a light-sensitive material and a processing solution. In respect of the color developing processing, it has been attempted to make higher the temperature, pH and concentration of a color developing agent, and it is also known to add additives such as development accelerators. The above development accelerators may include 1-phenyl-3-pyrazolidone disclosed in British Pat. No. 811,185, N-methyl-p-aminophenol disclosed in U.S. Pat. No. 2,417,514, N,N,N',N'-tetramethyl-p-phenylenediamine disclosed in Japanese Patent Publication Open to Public Inspection (hereinafter referred to as Japanese Patent O.P.I. Publication) No. 15554/1975, etc. The method using these, however, can achieve no sufficient rapidness, and may be often accompanied with deterioration of performance such as increase in fog.

On the other hand, the shape, size and composition of silver halide grains of a silver halide emulsion used in the light-sensitive material are known to greatly affect the development speed and so forth. In particular, it is found that the halogen composition may greatly affect the same and a very remarkably high development speed can be shown when a chloride-rich silver halide is used.

When, in general, the light-sensitive silver halide photographic materials are processed in a photofinishing laboratory over a long period of time while replenishing a replenishing solution, there is also a problem that the variation of photographic characteristics (in particular, the gradation variation) may be brought about by the change in the composition of a processing solution. This problem is becoming large with an increasing tendency of the low replenishing of the processing solution. Especially, it is nearly impossible to perfectly prevent a bleach-fixing solution from unintentionally mixing in a developing solution, even if the rate of replenishing the replenishing solution is strictly set, the evaporation is prevented, and nothing is made to be eluted from a light-sensitive material. Particularly in a roller conveyance type automatic processing machine, the state of things is such that there is caused a remarkable difference in the amount of unintentional mixing of the bleach-fixing solution into the developing solution, depending on the quantity of processing and the manner of the squeegeeing, and, in the event that the rate of replenishing the replenishing solution is lowered, the rotation speed of the replenishing solution is lowered to cause the further difference in the rate of the unintentional mixing.

The variation of photographic performances (in most cases, fog increase and gradation variation) caused by such unintentional mixing of a bleach-fixing solution may be a great obstacle to stable and good color reproduction and gradation reproduction. Since, for the reasons mentioned above, it is very difficult to prevent the unintentional mixing itself of the bleach-fixing solution, preferred is that the variation of photographic performances is small even if the bleach-fixing solution is unintentionally mixed, in other words, that the so-called BF contamination resistance is good.

Also, the pH value of a color developing solution may vary because of excessiveness or insufficiency of the amount for the replenishment of a replenishing solution.

In general, the pH of a color developing solution is so closely related with the color development activity that the photographic performances (sensitivity, gradation and fog) may vary with the pH variation of the color development solution to impair the stability of the photographic performances. Therefore, preferred is that the variation of photographic performances is small against the pH change also, in other words, that the so-called pH variation resistance is good.

In order to newly produce a light-sensitive silver halide photographic material that may have a good rapid processing performance and processing stability and also may achieve excellent dye-image preservation, it was tried to use the high boiling solvent disclosed in Japanese Patent O.P.I. Publication No. 205447/1985 and the above chloride-rich silver halide emulsion in simple combination, but it was found that although excellent preservation of a dye-image can be achieved, there are disadvantages such that the color development performance is unexpectedly poor, fog is too high, and the processing stability is short.

Accordingly, since in the prior arts, none of the techniques is sufficient for newly producing the light-sensitive silver halide photographic material that may have good rapid processing performance and processing stability and also may achieve excellent dye-image preservation, a new technique that can solve the above problems has been sought after.

In view of the foregoing, the present inventors, as a result of intensive studies, have used a gold compound and an organic compound having particular structure in combination in the above system comprising the combination of the particular high boiling solvent and the chloride-rich silver halide emulsion, whereby it was possible to obtain the effect that could not be expected from any prior arts, and, as a result, they have found a technique to newly produce a light-sensitive silver halide photographic material excellent in the dye image preservation, rapid processing performance and processing stability, that has been impossible to obtain in any prior arts. The present invention has thus been accomplished.

SUMMARY OF THE INVENTION

A first object of the present invention is to provide a light-sensitive silver halide photographic material that can achieve excellent preservation of a dye image to be formed, and also is feasible for the rapid processing. A second object of the present invention is to provide a light-sensitive silver halide photographic material having superior BF contamination resistance and pH variation resistance, in other words, suffering less variation of photographic performances even with the variation of color developing conditions.

The above objects of the present invention can be achieved by a light-sensitive silver halide photographic material having a support and provided thereon with at least one silver halide emulsion layer containing a dye-forming coupler, wherein the light-sensitive silver halide photographic material is characterized in that at least one of said silver halide emulsion layer contains (i) said dye-forming coupler dispersed therein with use of a high boiling organic solvent having dielectric constant of 6.0 or less, (ii) silver halide grains containing a gold compound and having silver chloride content of 90 mole % or more, and (iii) a compound represented by General Formula (S) shown below.

General Formula (S):

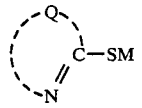

wherein Q is a group of atoms necessary to complete a 5- or 6-membered heterocyclic ring or a 5- or 6-membered ring fused with a benzene ring and M is a hydrogen atom, an alkali metal or an ammonium group.

DETAILED DESCRIPTION OF THE INVENTION

The present invention will be described below specifically.

Dye-forming couplers are used in the emulsion layers of the light-sensitive material according to the present invention.

These dye-forming couplers may preferably have intramolecularly a group, called a ballast group, having 8 or more of carbon atoms, capable of making the couplers non-diffusible.

Yellow dye-forming couplers that can be preferably used may include acylacetoanilide type couplers. Of these, advantageous are benzoylacetoanilide type and pivaloylacetonitrile type compounds. Preferably, they include the compounds represented by General Formula (Y) shown below:

General Formula (Y):

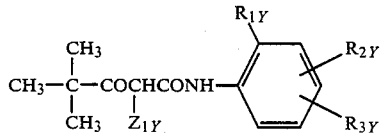

In the formula, $R_{1Y}$ represents a halogen atom or an alkoxy group. $R_{2Y}$ represents a hydrogen atom, a halogen atom, or an alkoxy group. $R_{3Y}$ represents an acylamino group, alkoxy carbonyl group, alkylsulfamoyl group, arylsulfamoyl group, arylsulfonamide group, alkylureido group, arylureido group, succinimide group, alkoxy group or aryloxy group. $Z_{1Y}$ represents a group eliminable through the coupling reaction with an oxidized product of a color developing agent.

Specific examples of usable yellow couplers are those disclosed in British Pat. No. 1,077,874, Japanese Patent Examined Publication No. 40757/1970, Japanese Patent O.P.I. Publications No. 1031/1972, No. 26133/1972, No. 94432/1973, No. 87650/1975, No. 3631/1976, No. 115219/1977, No. 99433/1979, No. 133329/1979 and No. 30127/1981, U.S. Pat. Nos. 2,875,057, No. 3,253,924, No. 3,265,506, No. 3,408,194, No. 3,551,155, No. 3,511,156, No. 3,664,841, No. 3,725,072, No. 3,730,722, No. 3,891,445, No. 3,900,483, No. 3,929,484, No. 3,933,500, No. 3,973,968, No. 3,990,896, No. 4,012,259, No. 4,022,620, No. 4,029,508, No. 4,057,432, No. 4,106,942, No. 4,133,958, No. 4,269,936, No. 4,286,053, No. 4,304,845, No. 4,314,023, No. 4,336,327, No. 4,356,258, No. 4,386,155 and No. 4,401,752, etc.

Magenta couplers that can be preferably used may include 5-pyrazolone type couplers, pyrazoloazole type couplers, etc. More preferably, they include the couplers represented by General Formula (P) or (aI) shown below.

General Formula (P):

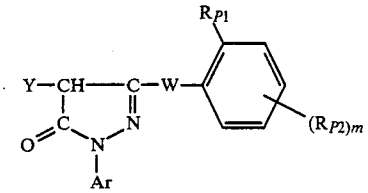

In the formula, Ar represents an aryl group; $R_{p1}$ represents a hydrogen atom or a substituent; and $R_{p2}$ represent a substituent. Y represents a group eliminable through the reaction with an oxidized product of a color developing agent; W represents 13 NH—, —NH-CO— (where the nitrogen atom is attached to a carbon atom in the pyrazolone ring) or —NHCONH—; and m is an integer of 1 or 2.

General Formula (aI):

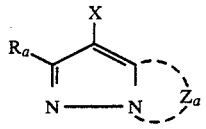

In the formula, $Z_a$ represent a group of non-metallic atoms necessary for the formation of a nitrogen-containing heterocyclic ring, and the ring to be formed by the $Z_a$ may have a substituent.

X represents a hydrogen atom or a substituent eliminable through the reaction with an oxidized product of a color developing agent.

$R_a$ represents a hydrogen atom or a substituent.

The substituent represented by the above $R_a$ may include, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, an organic hydrocabon compound residual group, an alkoxy group, an aryloxy group, a heterocyclic oxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxy carbonyl group, an aryloxycarbonyl group, an alkylthio group, an arylthio group and a heterocyclic thio group.

These are disclosed, for example, in U.S. Pat. Nos. 2,600,788, No. 3,061,432, No. 3,062,653, No. 3,127,269, No. 3,311,476, No. 3,152,896, No. 3,419,391, No. 3,519,429, No. 3,555,318, No. 3,684,514, No. 3,888,680, No. 3,907,571, No. 3,928,044, No. 3,930,861, No. 3,930,866 and No. 3,933,500, Japanese Patent O.P.I. Publications No. 29639/1974, No. 111631/1974, No. 129538/1974, No. 13041/1975, No. 58922/1977, No. 62454/1980, No. 118034/1980, No. 38043/1981, No. 35858/1982 and No. 23855/1985, British Pat. No. 1,247,493, Belgian Pat. Nos. 769,116 and 792,525, West German Pat. No. 21 56 111, Japanese Patent Examined Publication No. 60479/1971, Japanese Patent O.P.I. Publications No. 125732/1984, No. 228252/1984, No. 162548/1984, No. 171956/1984, No. 33552/1985 and No. 43659/1985, West German Pat. No. 10 70 030, U.S. Pat. No. 3,725,067, etc.

Cyan dye-forming couplers to be used may include phenol type and naphthol type cyan dye-forming couplers. Of these, preferably used are the couplers represented by General Formula (E) or (F) shown below.

General Formula (E):

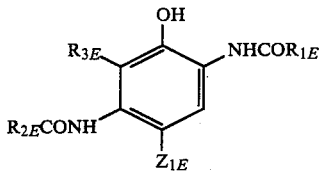

In the formula, $R_{1E}$ represents an aryl group, a cycloalkyl group or a heterocyclic group. $R_{2E}$ represents an alkyl group or a phenyl group. $R_{3E}$ represents a hydrogen atom, a halogen atom, an alkyl group or an alkoxy group. $Z_{1E}$ represents a hydrogen atom, a halogen atom or a group eliminable through the reaction with an oxidized product of an aromatic primary amine type color developing agent.

General Formula (F):

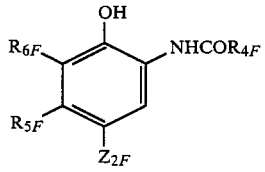

In the formula, $R_{4F}$ represents an alkyl group (for example, a methyl group, an ethyl group, a propyl group, a butyl group, a nonyl group, etc.). $R_{5F}$ represents an alkyl group, (for example, a methyl group, an ethyl group, etc.). $R_{6F}$ represents a hydrogen atom, a halogen atom (for example, fluorine, chlorine, bromine, etc.) or an alkyl group (for example, a methyl group, an ethyl group, etc.). $Z_{2F}$ represents a hydrogen atom, a halogen atom or a group eliminable through the reaction with an oxidized product of an aromatic primary amine type color developing agent.

These cyan dye-forming couplers are disclosed in U.S. Pat. Nos. 2,306,410, No. 2,356,475, No. 2,362,598, No. 2,367,531, No. 2,369,929, No. 2,423,730, No. 2,474,293, No. 2,476,008, No. 2,498,466 No. 2,545,687, No. 2,728,660, No. 2,772,162, No. 2,895,826, No. 2,976,146, No. 3,002,836, No. 3,419,390, No. 3,446,622, No. 3,476,563, No. 3,737,316, No. 3,758,308, and No. 3,839,044, British Pat. Nos. 478,991, No. 945,542, No. 1,084,480, No. 1,377,237, No. 1,388,024 and No. 1,543,040, Japanese Patent O.P.I. Publications No. 37425/1972, No. 10135/1975, No. 25228/1975, No. 112038/1975, No. 117422/1975, No. 130441/1975, No. 6551/1976, No. 37647/1976, No. 52828/1976, No. 108841/1976, No. 109630/1978, No. 48237/1979, No. 66129/1979, No. 131931/1979, No. 32071/1980, No. 146050/1984, No. 31953/1984 and No. 117249/1985, etc.

The dye-image forming couplers used in the present invention may be used in the respective silver halide emulsion layers usually in the range of $1\times10^{-3}$ mole to 1 mole, preferably $1\times10^{-2}$ mole to $8\times10^{-1}$ mole, per mole of silver halide..

Usually, the above dye-forming couplers may be added by dissolving the couplers in a high boiling organic solvent having a boiling point of 150° C. or more optionally together with a low boiling and/or water soluble organic solvent, and carrying out emulsification dispersion in a hydrophilic binder such as an aqueous gelatin solution by use of a surface active agent, followed by adding the dispersion to an intended hydrophilic colloid layer. There may be inserted a step of removing the dispersing solution or, at the same time of the dispersion, the low boiling organic solvent.

In the present invention, the ratio of the high boiling organic solvent of the present invention to the low boiling organic solvent may preferably be 1:0.1 to 1:50, more preferably 1:1 to 1:20.

The high boiling organic solvent according to the present invention may be any of the compounds having dielectric constant of 6.0 or less. There is no particular limitation in the minimum, but preferably the dielectric constant may be 1.9 or more. As the high boiling organic solvent that can be used in combination, there may be included esters such as phthalates and phosphates, organic amides, ketones, hydrocarbon compounds, etc. having the dielectric constant of 6.0 or less. More preferred are phthalates or phosphates.

Preferred is a high boiling organic solvent having the vapor pressure of 0.5 mmHg at 100° C. The organic solvent may be a mixture of two or more types, provided that this mixture may have the dielectric constant of 6.0 or less. The high boiling organic solvent that can be used in combination may include, for example, dibutyl phthalate, dimethyl phthalate, tricresyl phosphate, tributyl phosphate, etc. The dielectric constant mentioned in this invention refers to the dielectric constant at 30° C.

The phthalates may include the compound represented by General Formula (HA) shown below:

General Formula (HA)

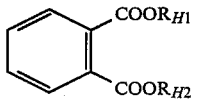

$R_{H1}$ and $R_{H2}$ each represent an alkyl group, an alkenyl group or an aryl group, provided, however, that the sum of carbon atom numbers of the groups represented by $R_{H1}$ and $R_{H2}$ is 9 to 32. More preferably, the sum of the carbon atom numbers is 16 to 24.

The alkyl group represented by $R_{H1}$ and $R_{H2}$ in the above General Formula (HA) may be straight chain or branched one, including, for example, a butyl group, a hexyl group, a heptyl group, an octyl group, a nonyl group, a dodecyl group, a tetradecyl group, a hexadecyl group, a heptadecyl group, an octadecyl group, etc. The ary group represented by $R_{H1}$ and $R_{H2}$ may include, for example, a phenyl group, a naphthyl group, etc.; the alkenyl group may include, for example, a hexenyl group, a heptenyl group, an octadecenyl group. These alkyl group, alkenyl group and aryl group may have a single or plural number of substituent(s). In the above, $R_{H1}$ and $R_{H2}$ may preferably be an alkyl group, including, for example, a 2-ethylhexyl group, a 3,5,5-trimethylhexyl group, a n-octyl group, a n-nonyl group, etc.

The phosphates may include those represented by General Formula (HB) shown below:

General Formula (HB)

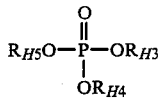

$R_{H3}$, $R_{H4}$ and $R_{H5}$ each represent an alkyl group, an alkenyl group or an aryl group, provided, however, that the sum of the carbon atom numbers of the groups represented by $R_{H3}$, $R_{H4}$ and $R_{H5}$ is 24 to 54.

The alkyl group represented by $R_{H3}$, $R_{H4}$ and $R_{H5}$ in General Formula (HB) may include, for example, a butyl group, a pentyl group, a hexyl group, an octyl group, a nonyl group, a dodecyl group, a pentadecyl group, a hexadecyl group, an octadecyl group, a nonadecyl group, etc.

These alkyl group, alkenyl group and aryl group may have a single or plural number of substituent(s). Preferably, $R_{H3}$, $R_{H4}$ and $R_{H5}$ each reresent an alkyl group, including, for example, a 2-ethylhexyl group, a n-octyl group, a 3,5,5-trimethylhexyl group, a n-nonyl group, a n-decyl group, a sec-decyl group, a sec-dodecyl group, a t-octyl group, etc.

Typical examples of the organic solvents are shown below, but this invention is by no means limited to these.

General Formula (HA):

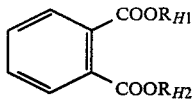

| Comp. No. | $R_{H1}$ | $R_{H2}$ |
|---|---|---|
| H-1 | $-C_6H_{13}(n)$ | $-C_6H_{13}(n)$ |
| H-2 | $-CH_2CH(C_2H_5)(CH_2)_3CH_3$ | $-CH_2CH(CH_2)_3CH_3$ <br> $\lvert$ <br> $C_2H_5$ |
| H-3 | $-C_8H_{17}(n)$ | $-C_8H_{17}(n)$ |
| H-4 | $-C_9H_{19}(i)$ | $-C_9H_{19}(i)$ |
| H-5 | $-C_9H_{19}(n)$ | $-C_9H_{19}(n)$ |
| H-6 | $-CH_2CH_2CH(CH_3)CH_2C(CH_3)_2-CH_3$ | $-CH_2CH_2CH(CH_3)CH_2C(CH_3)_2-CH_3$ |
| H-7 | $-C_{10}H_{21}(i)$ | $-C_{10}H_{21}(i)$ |
| H-8 | $-C_{10}H_{21}(n)$ | $-C_{10}H_{21}(n)$ |
| H-9 | $-C_{11}H_{23}(i)$ | $-C_{11}H_{23}(i)$ |
| H-10 | $-C_{12}H_{25}(n)$ | $-C_{12}H_{25}(n)$ |
| H-11 | $-C_{12}H_{25}(i)$ | $-C_{12}H_{25}(i)$ |

General Formula (HB):

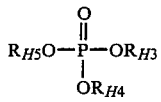

| Comp. No. | $R_{H3}$ | $R_{H4}$ | $R_{H5}$ |
|---|---|---|---|
| H-12 | $-CH_2CH(C_2H_5)(CH_2)_3CH_3$ | $-CH_2CH(C_2H_5)(CH_2)_3CH_3$ | $-CH_2CH(C_2H_5)(CH_2)_3CH_3$ |
| H-13 | $-C_9H_{19}$(i) | $-C_9H_{19}$(i) | $-C_9H_{19}$(i) |
| H-14 | $-C_9H_{19}$(n) | $-C_9H_{19}$(n) | $-C_9H_{19}$(n) |
| H-15 | $-C_{10}H_{21}$(i) | $-C_{10}H_{21}$(i) | $-C_{10}H_{21}$(i) |
| H-16 | $-C_{10}H_{21}$(n) | $-C_{10}H_{21}$(n) | $-C_{10}H_{21}$(n) |
| H-17 | $-C_{11}H_{23}$(i) | $-C_{11}H_{23}$(i) | $-C_{11}H_{23}$(i) |
| H-18 | $-C_{12}H_{25}$(i) | $-C_{12}H_{25}$(i) | $-C_{12}H_{25}$(i) |
| H-19 | 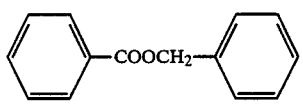 | | |
| H-20 | 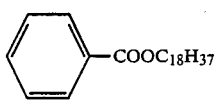 | | |
| H-21 | 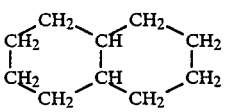 | | |
| H-22 | 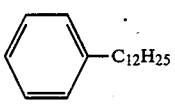 | | |

The high boiling organic solvent according to the present invention can be used in the range of 0.01 mole to 10 moles, preferably 0.05 mole to 5 moles, per mole of silver halide.

The silver halide grains of the present invention have silver chloride content of 90 mole % or more, and silver bromide content of preferably 10 mole % or less, and silver iodide content of 0.5 mole % or less. More preferably, the grains may comprise silver chlorobromide having silver bromide content of 0.05 to 5 mole %.

The silver halide grains may be used alone or as a mix with other silver halide grains having different composition. They may be also used as a mix with silver halide grains having silver chloride content of 10 mole % or less.

In the silver halide emulsion layer containing the silver halide grains of the present invention, having the silver chloride content of 90 mole % or more, the silver halide grains having the silver chloride content of 90 mole % or more may be held in the whole silver halide grains contained in said emulsion layer, in the proportion of 60% by weight or more, preferably 80% by weight or more.

The composition of the silver halide grains of the present invention may be homogeneous from inside to outside of a grain, or may be different between the inside and outside of a grain. In the case the composition is different between the inside and outside of a grain, the composition may vary continuously or discontinuously.

There is no particular limitation in the grain size of the silver halide grains of the present invention, but it may preferably range between 0.2 and 1.6 μm, more preferably 0.25 and 1.2 μm. The above grain size can be measured according to various methods generally used in the present technical field. A typical method is disclosed in Rabland, "Grain Size Analytical Method" (A.S.T.M. Symposium on Light Microscopy, pp. 94–122, 1955) or "The Theory of The Photographic Process" (by Meath and James, Third Edition, published by Macmillan Publishing Co., Inc., see Second Paragraph).

This grains size can be measured by use of a projection area or diametric approximate value of a grain. In the case the grains are substantially of uniform shape, the grain size distribution can be considerably precisely expressed as the diameter or the projection area.

The distribution of grain size of the silver halide grains of the present invention may be either polydisperse or monodisperse. The silver halide grains may preferably monodisperse silver halide grains having the variation coefficient in the grain size distribution of the silver halide grains, of 0.22 or less, more preferably 0.15 or less. Here, the variation coefficient is the coefficient showing the width of grain size distribution, and defined by the following equation:

$$\text{Variation coefficient } (S/\bar{r}) = \frac{\text{Standard deviation of grain size distribution}}{\text{Average grain size}}$$

$$\text{Standard deviation } (S) \text{ of grain size distribution} = \sqrt{\frac{\Sigma\,(\bar{r} - ri)^2 ni}{\Sigma\, ni}}$$

-continued $$\text{Average grain size } (\bar{r}) = \frac{\Sigma niri}{\Sigma ni}$$

Here, ri represents the grain size of the respective grains, and ni represents the number thereof. The grain size herein mentioned refers to its diameter in the case of a spherical silver halide grain, and, in the case of a cube or a grain having the shape other than a sphere, the diameter obtained by calculating its projected image to a circular image having the corresponding area.

The silver halide grains used in the emulsion of the present invention may be obtained by any of an acidic method, a neutral method and an ammoniacal method. The grains may be allowed to grow at one time, or grow after seed grains have been formed. The manner to prepare the seed grains and the manner to grow them may be same or different.

The manner to react a soluble silver salt with a soluble halogen salt may be any of a regular mixing method, a reverse mixing method and a simultaneous mixing method, or a combination of any of these, but preferred are grains formed by the simultaneous mixing method. As a type of simultaneous mixing method, there can be used the pAg-controlled double jet method disclosed in Japanese Patent O.P.I. Publication No 48521/1979.

If necessary, there may be further used a silver halide solvent such as thioether. The silver halide grains according to the present invention that can be used may have any shape. A preferable example is a cube having {100}face as a crystal surface. Also, grains having the shape of octahedros, tetradecahedrons, dodecahedrons, etc. may be prepared according to the procedures disclosed in the specifications of U.S. Pat. No. 4,183,756 and No. 4,225,666, Japanese Patent O.P.I. Publication No. 26589/1980, Japanese Patent Publication No. 42737/1980, etc., and the publications such as The Journal of Photographic Science, 21, 39 (1973), and these grains can be also used. There may be further used grains having a twin crystal face.

The silver halide grains according to the present invention that can be used may be grains comprising a single shape, or may be a mixtrue of grains having various shapes.

In the course of formation and/or growth of the silver halide grains used in the emulsion of the present invention, metal ions may be added to the grains by use of at least one of a cadmium salt, a zinc salt, a lead salt, a thallium salt, an iridium salt or a complex salt thereof, a rhodium salt or a complex salt thereof, and an iron salt or a complex salt thereof to incorporate any of these metal elements into the inside of the grains and/or the surface of the grains, and also a reduction sensitizing nuclei can be imparted to the inside of the grains and/or the surface of the grains by placing the grains in a suitable reductive atmosphere.

The emulsion containing the silver halide grains of the present invention (hereinafter "the emulsion of the present invention") may be either one from which unnecessary soluble salts have been removed after completion of the growth of silver halide grains, or one from which they remain unremoved. When the salts are removed, they can be removed according to the method disclosed in Research Disclosure No. 17643.

The silver halide grains used in the emulsion of the present invention may be grains such that a latent image is chiefly formed on the surface, or grains such that it is formed chiefly in the inside of a grain. Preferred are the grains in which a latent image is chiefly formed on the surface.

The emulsion of the present invention can be chemically sensitized according to conventional methods. Namely, a sulfur sensitization metho using a compound containing sulfur capable of reacting with silver ions, and active gelatin, a selenium sensitization method using a selenium compound, a reduction sensitization method using a reducing substance, and a noble metal sensitization method using noble metal compounds such as gold and so forth can be used alone or in combination.

In the present invention, a chalcogen sensitizer can be used as a chemical sensitizer. The chalgogen sensitizer is a general term for a sulfur sensitizer, a selenium sensitizer and a tellurium sensitizer. For photographic use, preferred are the sulfur sensitizer and the selenium sensitizer. The sulfur sensitizer may include, for example, thiosulfate, allythiocarbazide, thiourea, allylisothiocyanate, cystine, p-toluene thiosulfonate and rhodanine. Besides these, there can be also used the sulfur sensitizers disclosed in U.S. Pat. Nos. 1,574,944, 2,410,689, No. 2,278,947, No. 2,728,668, No. 3,501,313 and No. 3,656,955, German Laid-open Application (OLS) No. 14 22 866, Japanese Patent O.P.I. Publications No. 24937/1981 and No. 45016/1980, etc. The sulfur sensitizer may be added in an amount that may vary in a considerable range depending on the various conditions such as pH, temperature, size of silver halide grains, but, as a standard, preferably in an amount of $10^{-7}$ to $10^{-1}$ mole per mole of silver halide.

The selenium sensitizer can be used in place of the sulfur sensitizer, which selenium sensitizer may include isoselenocyanates such as allyisoselenocyanate, selenoureas, selenoketones, selenoamides, salts and esters of selenocarbonic acid, selenophosphates, and selenides such as diethyl selenide and diethyl diselenide. Examples of these are disclosed in U.S. Pat. No. 1,574,944, No. 1,602,592 and No. 1,623,499.

Reduction sensitization can be further used in combination. There is no particular limitation in a reducing agent, and it may include stannous chloride, thiourea dioxide, hydrazine, polyamine, etc.

Noble metal compounds other than gold, for example, palladium compounds or the like can be used in combination.

The silver halide grains according to the present invention contains a gold compund. The gold compound of the present invention may any of gold having the oxidation number of valence +1 or +3, and various gold compounds may be used. Typical examples thereof may include chloroaurate, potassium chloroaurate, auric trichloride, potassium auric thiocyanate, potassium iodoaurate, tetracyanoauric azide, ammonium aurothiocyanate, pyridyl trichlorogold, gold sulfide, gold selenide, etc.

The gold compounds may be used in such a manner that it may sensitize the silver halide grains or may be used in such a manner that it may not substantially contribute to the sensitization.

The gold compound may be added in an amount that may vary depending on various conditions, but, as a standard, in an amount of $10^{-8}$ to $10^{-1}$ mole, preferably $10^{-7}$ to $10^{-2}$ mole. The compound may be added at any time, i.e., at the time of the formation of silver halide grains, at the time of physical ripening, at the time of chemical ripening, or after completion of the chemical ripening.

Gold compounds are added preferably during the period of chemical ripening. As a chemical sensitizer to be used in this case, aforesaid gold compound may be used either independently or in combination with aforesaid chemical sensitizer (e.g. sulfur sensitizer, selenium sensitizer, reducing agent and others). In the present invention, it is especially preferable to use a gold compound independently as a sensitizing agent (so-called a gold sensitization) or to use a gold compound in combination with a sulfur sensitizer (so-called gold-sulfur sensitization). When the gold-sulfur sensitization is carried out, a gold compound and sulfur sensitizer may be added simultaneously or separately. When a gold compound and a sulfur sensitizer are added separately, either one of them may be added first.

The emulsion of the present invention can be spectrally sensitized to a desired wavelength region with use of a dye known in the photographic field as a sensitizing dye. The sensitizing dye may be used alone, but may be used in combination of two or more ones.

Together with the sensitizing dye, the emulsion may contain a supersensitizing agent which is a dye having itself no action of spectral sensitization or a compound substantially absorbing no visible light, and that can strengthen the sensitizing action of the sensitizing dye.

The light-sensitive silver halide photographic material contains the compound represented by General Formula (S).

General Formula (S):

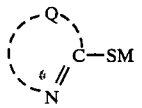

wherein Q is a group of atoms necessary to complete a 5- or 6-membered heterocyclic ring or a 5- or 6-membered ring fused with a benzene ring and M is a hydrogen atom, an alkali metal or an ammonium group.

The 5-membered heterocyclic ring represented by Q may include an imidazole ring, a tetrazole ring, a thiazole ring, an oxazole ring, a selenazole ring, a benzimidazole ring, a naphthoimidazole ring, a benzothiazole ring, a naphthothiazole ring, a benzoselenazole ring, a naphthoselenazole ring, a benzoxazole ring, etc., and the 6-membered heterocyclic ring may include a pyridine ring, a pyrimidine ring, a quinoline ring, etc. These 5- or 6-membered heterocyclic ring may include those having a substituent. The alkali metal atom represented by M may include a sodium atom, a potassium atom, etc.

Of the compound represented by General Formula (S), particularly preferable compound may include the compounds represented respectively by General Formula (SA), General Formula (SB) and General Formula (SD) shown below.

General Formuls (SA):

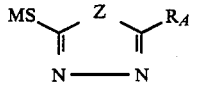

Z represents

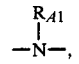

an oxygen atom, or a sulfur atom. $R_A$ represents a hydrogen atom, an alkyl group, an aryl group, an alkenyl group, a cycloalkyl group, $—SR_{A1}$,

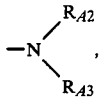

wherein $R_{A1}$ represents a hydrogen atom, an alkyl group, an alkenyl group, a cycloalkyl group, an aryl group, a $—COR_{A4}$, or $—SO_2R_{A5}$; $R_{A2}$ and $R_{A3}$ each represent a hydrogen atom, an alkyl group or an aryl group; and $R_{A4}$ and $R_{A5}$ each represents an alkyl group or an aryl group. M represents a hydrogen atom, an alkali metal atom or an ammonium group.

The alkyl group represented by $R_{A1}$, $R_{A2}$, $R_{A3}$, $R_{A4}$ and $R_{A5}$ in General Formula (SA) may include, for example, a methyl group, a benzyl group, an ethyl group, a propyl group, etc.; and the aryl group may include a phenyl group, a naphthyl group, etc.

The alkenyl group represented by $R_A$ and $R_{A1}$ may include, for example, a propenyl group, etc.; and the cycloalkyl group, may include, for example, a cyclohexyl group, etc. The heterocyclic group represented by $R_A$ may include, for example, a furyl group, a pyridinyl group, etc.

The above alkyl group and aryl group represented by $R_{A1}$, $R_{A2}$, $R_{A3}$, $R_{A4}$ and $R_{A5}$ and the alkenyl group and cycloalkyl group represented by $R_A$ and $R_{A1}$ may also include those further having a substituent.

The alkali metal atom represented by M may include a potassium atom, a sodium atom, etc.

General Formula (SB):

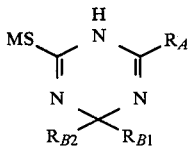

$R_A$ and M have the same meaning as $R_A$ and M in General Formula (SA) respectively. $R_{B1}$ and $R_{B2}$ have also the same meaning as $R_{A1}$ and $R_{A2}$ in General Formula (SA) respectively.

The alkyl group represented by $R_A$ and $R_B$ in General Formulas (SA) and (SB) may include, for example, a methyl group, an ethyl group, a butyl group, etc.; the alkoxy group may include, for example, a methoxy group, an ethoxy group, etc.; and the salt of the carboxyl group or sulfo group may include, for example, a sodium salt, an ammonium salt, etc.

In General Formula (SA), the ary group represented by $R_A$ may include, for example, a phenol group, a naphthyl group, etc.; and the halogen atom may include, for example, a chlorine atom, a bromine atom, etc.

General Formula (SD):

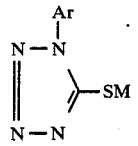

In the formula, Ar represents a group of;

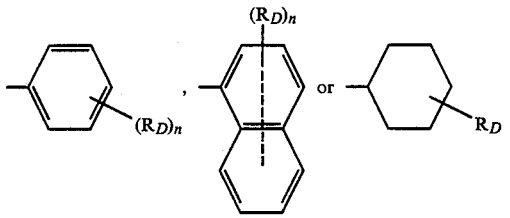

$R_D$ represents an alkyl group, an alkoxy group, a carboxyl group or a salt thereof, a sulfo group or a salt thereof, a hydroxyl group, an amino group, an acylamino group, a carbamoyl group, or a sulfonamide.

n represents an integer of 0 to 2.

M has the same meaning with M in General Formula (S).

In General Formula (SD), the alkyl group represented by $R_D$ may include, for example, a methyl group, an ethyl group, a butyl group, etc.; the alkoxy group may include, for example, a methoxy group, an ethoxy group, etc.; and the salt of the carboxyl group or sulfo group may include, for example, a sodium salt, an ammonium salt, etc; the acylamino group represented by $R_D$ may include, for example, a methylcarbonylamino group, a benzoylamino group, etc.; the carbamoyl group may include, for example, an ethylcarbamoyl group, a phenylcarbamoyl group, etc.; and the sulfonamide group may include, for example, a methylsulfonamide group, a phenylsulfonamide, etc.

The above alkyl group, alkoxy group, aryl group, amino group, acylamino group, carbamoyl group, sulfonamide group, etc. may also contain those further having a substituent.

Typical examples of the compound represented by General Formula (S) are shown below.

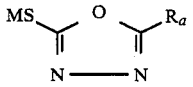

| Exemplary compound | Ra | M |
|---|---|---|
| S-1 | $-C_2H_5$ | —H |
| S-2 | $-CH_2-CH=CH_2$ | —H |
| S-3 | $-CH=CH-CH_2-CH_3$ | —H |
| S-4 | $-C_7H_{15}$ | —H |
| S-5 | $-C_9H_{19}$ | —Na |
| S-6 | 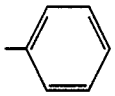 | —H |
| S-7 | $-C_4H_9(t)$ | —H |
| S-8 | 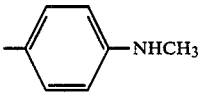 | —H |
| S-9 | 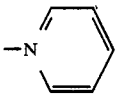 | —H |
| S-10 | 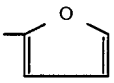 | —H |
| S-11 | 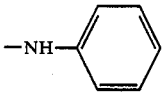 | —H |
| S-12 | 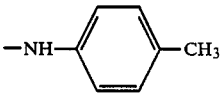 | $-NH_4$ |
| S-13 | $-NHCOCH_3$ | —H |

-continued
| | | |
|---|---|---|
| S-14 | $-NHSO_2-$ 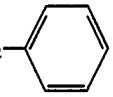 | —H |
| S-15 | $-N(CH_3)_2$ | —H |
| S-16 | $-NHCH_2-$ 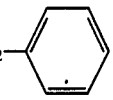 | —H |
| S-17 | $-CH_2-$ 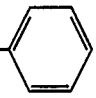 | —H |
| S-18 | $-S-CH_3$ | —H |
| S-19 | $-S-$ 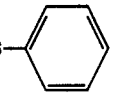 | —H |
| S-20 | —SH | —H |
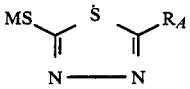
| Exemplary compound | $R_A$ | M |
|---|---|---|
| S-21 | —H | —H |
| S-22 | $-C_2H_5$ | —H |
| S-23 | $-C_4H_9(t)$ | —H |
| S-24 | $-C_6H_{13}$ | —H |
| S-25 | 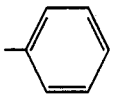 | —H |
| S-26 | 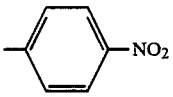 | —H |
| S-27 | 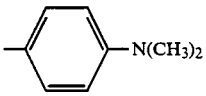 | —H |
| S-28 | 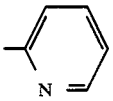 | —H |
| S-29 | 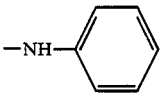 | —H |
| S-30 | $-N(CH_3)_2$ | —H |
| S-31 | $-CH_2CH=CH_2$ | —H |
| S-32 | —SH | —H |
| S-33 | $-NHCOC_2H_5$ | —H |
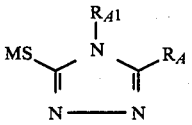

-continued
| Exemplary compound | $R_A$ | $R_{A1}$ | M |
|---|---|---|---|
| S-34 | $-C_2H_5$ | $-H$ | $-H$ |
| S-35 | $-CH_3$ | $-CH_3$ | $-H$ |
| S-36 | $-CH_3$ | 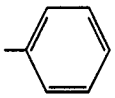 | $-H$ |
| S-37 | $-NHCOCH_3$ | $-CH_3$ | $-H$ |
| S-38 | 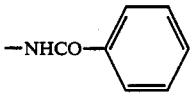 | 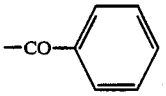 | $-H$ |
| S-39 | $-NHCOCH_3$ | $-COCH_3$ | $-H$ |
| S-40 | $-NHCOCH_3$ | 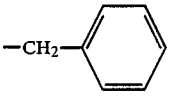 | $-H$ |
| S-41 | $-NHCOC_2H_5$ | 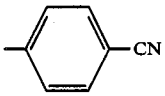 | $-Na$ |
| S-42 | 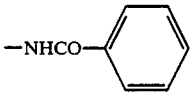 | 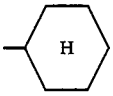 | $-H$ |
| S-43 | $-NHSO_2CH_3$ | $-H$ | $-H$ |
| S-44 | 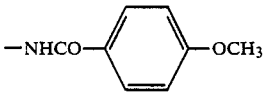 | $-CH_3$ | $-Na$ |
| S-45 | 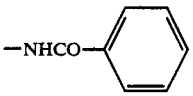 | $-CH_2CH{=}CH_2$ | $-H$ |
| S-46 | 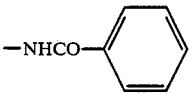 | 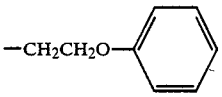 | $-H$ |
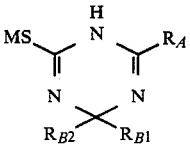
| Exemplary compound | $R_A$ | $R_{B1}$ | $R_{B2}$ | M |
|---|---|---|---|---|
| S-47 | $-C_2H_5$ | $-CH_3$ | $-CH_3$ | $-H$ |
| S-48 | 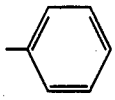 | $-CH_3$ | $-CH_3$ | $-H$ |
| S-49 | $-NH_2$ | $-H$ | 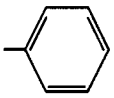 | $-H$ |

-continued
| | | | | |
|---|---|---|---|---|
| S-50 | 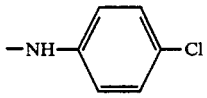 | —H | —$C_4H_9$ | —H |
| S-51 | —$NHCOCH_3$ | —$CH_3$ | —$CH_3$ | —H |
| S-52 | 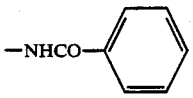 | —$CH_3$ | —$CH_3$ | —H |
| S-53 | 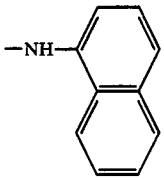 | —$CH_3$ | —$C_3H_7$(i) | —H |
| S-54 | 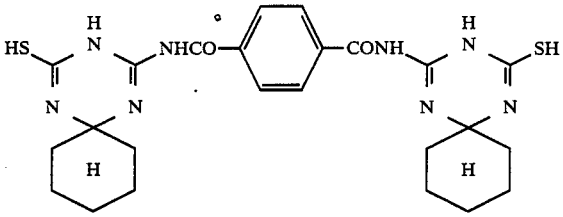 | | | |
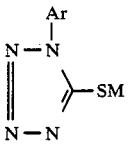
| Exemplary compound | Ar | M |
|---|---|---|
| S-55 | 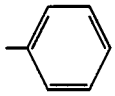 | —H |
| S-56 | 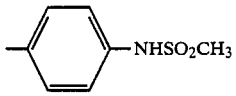 | —H |
| S-57 | 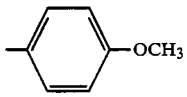 | —Na |
| S-58 | 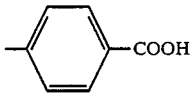 | —H |
| S-59 | 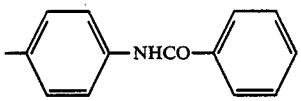 | —H |
| S-60 | 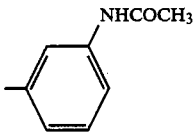 | —H |

-continued

| | | |
|---|---|---|
| S-61 | 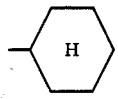 | —Na |
| S-62 | 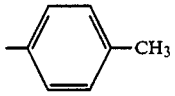 | —H |
| S-63 | 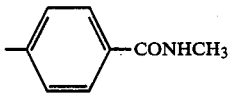 | —H |
| S-64 | 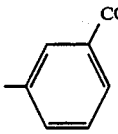 | —H |
| S-65 | 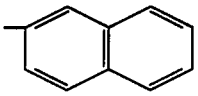 | —$NH_4$ |
| S-66 | 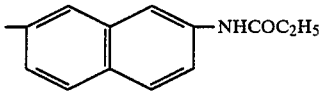 | —H |
| S-67 | 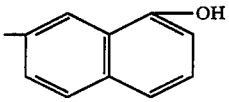 | —H |
| S-68 | 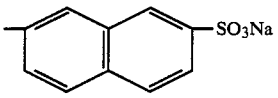 | —H |

The compound represented by General Formula (S) may include the compounds disclosed, for example, in Chemical and Pharmaceutical Bulletin, Tokyo, Vol. 26, 314 (1978), Japanese Patent O.P.I. Publication No. 79436/1980, Berichte der Deutschen Chemischem Gesellsdragt, 82, 121 (1948), U.S. Pat. No. 2,843,491 and No. 3,107,270, British Pat. No. 940,169, Japanese Patent O.P.I. Publication No. 102639/1976, Journal of American Chemical Society, 44, 1502–1510, Japanese Patent O.P.I. Publication No. 59463/1980, etc., which can be synthesized according to the procedures also disclosed in these publications.

To incorporate the compound represented by General Formula (S) according to this invention (hereinafter "Compound (S)") into the silver halide emulsion layer of the present invention, it may be dissolved in water or in a freely water-miscible organic solvent (for example, methanol, ethanol, etc.), and then added. The compound (S) may be used alone or in combination with other compounds represented by General Formula (S) or any stabilizer or fog restrainer other than the compound represented by General Formula (S).

The compound (S) may be added at any time before formation of silver halide grains, during formation of silver halide grains, after completion of the formation of silver halide grains and before initiation of chemical ripening, during chemical ripening, at the time of completion of chemical ripening, or after completion of chemical ripening and before coating. Preferably, it may be added during chemical ripening, at the time of completion of chemical ripening, or after completion of chemical ripening and before coating. The addition may be carried out by adding the whole amount in one time, or by dividing it into several times.

As to the place for the addition, the compound may be added directly to a silver halide emulsion or a coating solution of the silver halide emulsion, or may be added to a coation solution for an adjacent non-light-sensitive hydrophilic colloid layer so that the compound may be contained in the silver halide emulsion layer of the present invention by the action of diffusion at the time of multi-layer coating.

There is no particular limitation in the amount for the addition, but the compound may be added usually in the range of $1\times10^{-6}$ mole to $1\times10^{-1}$, preferably $1\times10^{-5}$ to $1\times10^{-2}$.

Some of Compound (S) of the present invention are compounds known in the present industrial field as stabilizers or antifoggants. For example, they are disclosed in British Pat. No. 1,273,030, Japanese Patent Publication No. 9936/1983, Japanese Patent Publication No. 27010/1985, Japanese Patent O.P.I. Publication No. 102639/1976, Japanese Patent O.P.I. Publication No. 22416/1978, Japanese Patent O.P.I. Publication No. 59463/1980, Japanese Patent O.P.I. Publication No. 79436/1980 and Japanese Patent O.P.I. Publication No. 232342/1984, etc. However, in the above known publications, through having the descriptions relating to the restraint of fog or stabilization of emulsions, the effect obtainable by the present invention, i.e., the effect achieved when the grains having the high silver chloride content and containing the gold compound is subjected to the color developing, has not been known at all. In general, Compound (S) is known as compounds that can show the fog restraint action and so forth while being accompanied with desensitization and development restraint (as disclosed, for example in "Fundamentals of Photographic Industries, Silver Salt Edition", Koronasha Co., p.195, 1979). It was quite unexpected effect that these compounds can improve the rapid processing performance when applied in the system of the present invention.

Moreover, in respect of the processing stability in the system of the present invention, there was also obtained quite unexpected effect such that the light-sensitive material can have good and stable reproducibility against the photographic variation, for example, the gradation variation, due to the inclusion of a bleach-fixing solution into a color developing solution and the pH variation of the color developing solution, in other words, it can be excellent in the so-called BF contamination resistance and pH variation resistance. Reviewing more specifically, the compound included in the compound of General Formula (SA), wherein z represents —N—R, the same compound wherein Z represents an oxygen atom, and the compound represented by General Formula (SD) shows great effect in the BF contamination resistance, and the compound of General Formula (SB) shows great effect in the pH variation resistance.

The above consideration is based on nothing more than supposition, and the fact is still unclear.

In the present invention, to harden the silver halide emulsion layer, it is preferable to use a hardening agent of a chlorotraizine type, represented by General Formula (HDA) or (HDB) shown below.

General Formula (HDA):

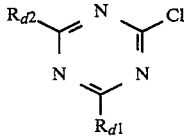

In the formula, $R_{d1}$ represents a chlorine atom, a hydroxyl group, an alkyl group, an alkoxy group, an alkylthio group, an —OM group (wherein M is a monovalent metal atom), an —NR'R'' group (wherein R' and R'' each represent a hydrogen atom, an alkyl group or an aryl group), or an —NHCOR''' (wherein R''' represents a hyrogen atom, an alkyl group or an aryl group); and $R_{d2}$ represents a group having the same meaning as the above $R_{d1}$, excluding a chlorine atom.

General Formula (HDB):

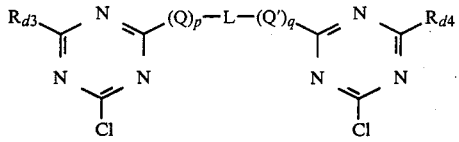

In the formula, $R_{d3}$ and $R_{d4}$ each represent a chlorine atom, a hydroxyl group, an alkyl group, an alkoxy group or an —OM group (wherein M is a monovalent metal atom). Q and Q' each represent a linking group showing —O—, —S— or —NH—; L represents an alkylene group or an arylene group; and p and q each represent 0 or 1.

Typical examples of the preferred hardening agent represented by the above General Formulas (HDA) and (HDB) are described below.

General Formula (HDA):

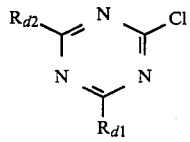

| Comp. No. | $R_{d1}$ | $R_{d2}$ |
|---|---|---|
| HD-1 | —OH | —ONa |
| HD-2 | —Cl | —ONa |
| HD-3 | —$OCH_3$ | —ONa |
| HD-4 | —Cl | —$OC_2H_5$ |
| HD-5 | —Cl | —OK |
| HD-6 | —OH | —OK |
| HD-7 | —Cl | —$NH_2$ |
| HD-8 | —Cl | —$NHCOCH_3$ |
| HD-9 | —OH | —$NHC_2H_5$ |

General Formula (HDB):

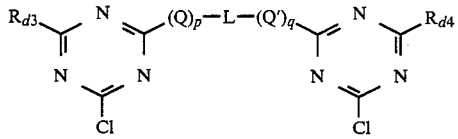

| Comp. No. | $R_{d3}$ | $R_{d4}$ | Q | p | Q' | q | L |
|---|---|---|---|---|---|---|---|
| HD-10 | —Cl | —Cl | O | 1 | O | 1 | 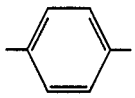 |
| HD-11 | —ONa | —ONa | O | 1 | O | 1 | —$CH_2CH_2$— |
| HD-12 | —ONa | —ONa | — | 0 | — | 0 | —$CH_2CH_2$— |
| HD-13 | —$OCH_3$ | —$OCH_3$ | S | 1 | S | 1 | —$CH_2CH_2$— |
| HD-14 | —ONa | —ONa | H —N— | 1 | H —N— | 1 | —$CH_2CH_2$— |
| HD-15 | —ONa | —ONa | H —N— | 1 | O | 1 | —$CH_2CH_2$— |

To add the hardening agent represented by General Formula (HDA) or (HDB) to silver halide emulsion layers and other constituent layers, it may be dissolved in water or a water-miscible solvent (for example, methanol, ethanol, etc.), and then the solution may be added to coating solutions for the above constituent layers. The addition may be carried out according to any of the batch system and the in-line system. There is no particular limitation in the timne of the addition, but it may be preferably added immediately before coating.

These hardening agents may be added in an amount of 0.5 to 100 mg, preferably 2.0 to 50 mg, based on 1 g of gelatin to be coated.

An image-stabilizing agent to prevent the deterioration of a dye image can be used in the light-sensitive silver halide photographic material of the present invention.

Hydrophilic colloid layers such as protective layers and intermediate layers of the light-sensitive material of the present invention may contain an ultraviolet absorbent.

The ultraviolet absorbent may preferably include benzotriazole compounds substituted with an aryl group (for example, those disclosed in Japanese Patent Publication Nos. 10466/1961, 1687/1966, 26187/1967, 29620/1969 and No. 41572/1973, Japanese Patent O.P.I. Publications Nos. 95233/1979 and 142975/1982, U.S. Pat. Nos. 3,253,921, 3,533,794, 3,754,919, 3,794,493, 4,4009,038, 4,220,711 and 4,323,633, and Research Disclosure No. 22519).

The light-sensitive silver halide photographic material of this invention can be exposed by use of electromagnetic wave having the spectral region to which the emulsion layers constituting the light-sensitive material of the present invention have the sensitivity. As a light source, there can be used any known light sources including natural light (sunlight), a tungsten lamp, a fluorescent lamp, a mercury lamp, a xenon arc lamp, a carbon arc lamp, a xenon flash lamp, a cathode ray tube flying spot, every kind of laser beam, light from a light-emitting diode, light emitted from a fluorescent substance energized by electron rays, X-rays, gamma-rays alpha-rays, etc.

As for the exposure time, it is possible to make exposure, not to speak of exposure of 1 millisecond to 1 second usually used in cameras, of not more than 1 microsecond, for example, 100 microseconds to 1 microsecond by use of a cathode ray tube or a xenon arc lamp, and it is also possible to make exposure longer than 1 second. Such exposure may be carried out continuously or may be carried out intermittently.

The color developing agent used in the color developing solution in the present invention includes known ones widely used in the various color photographic processes. These developing agents include aminophenol type and p-phenylenediamine type derivatives. These compounds, which are more stable than in a free state, are used generally in the form of a salt, for example, in the form of a hydrochloride or a sulfate. Also, these compounds are used generally in concentration of about 0.1 to 30 g per 1 liter of a color developing solution, preferably in concentration of about 1 to 15 g per 1 liter of a color developing solution.

The aminophenol type developing agent may include, for example, o-aminophenol, p-aminophenol, 5-amino-2- oxytoluene, 2-amino-3-oxy-toluene, 2-oxy-3-amino-1,4-dimethyl-benzene, etc.

Most useful primary aromatic amine type color developing agent includes N, N'-dialkyl-p-phenylenediamine compound, wherein the alkyl group and the phenyl group may be substituted with any substituent. Of these, examples of particularly useful compounds may include N-N'-dimethyl-p-phenylenediamine hydrochloride, N-methyl-p-phenylenediamine hydrochloride, N,N'-dimethyl-p-phenylenediamine hydrochloride, 2-amino-5(N-ethyl-N-dodecylamino)-toluene, N-ethyl-N-βmethanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-touluene sulfonate, etc.

In additon to the above primary aromatic amine type color developing agent, the color developing agent used in the processing of the light-sensitive silver halide photographic material according to the present invention may also contain known compounds for developing solution components. For example, there may be optionally contained alkali agents such as sodium hydroxide, sodium carbonate and potassium carbonate, alkali metal thiocyanates, benzyl alcohol, water softening agents, thickening agents, etc.

This color developing solution may have usually the pH of 7 or more, most usually about 10 to 13.

The color development temperature may be usually 15° C. or more, and generally in the range of 20° C. to 50° C. For the rapid processing, the developing may be preferably carried out at 30° C. or more. The color development time may be preferably in the range of 20 seconds to 60 seconds, more preferably in the range of 30 seconds to 50 seconds.

The light-sensitive silver halide photographic material according to the present invention may contain the above color developing agent in hydrophilic colloid layers as a color developing agent itself or as a precursor thereof, and may be processed by use of an alkaline activated bath. The precursor of color developing agent is a compound capable of forming a color developing agent under the alkaline condition, and may include precursors of the type of a Schiff base with an aromatic aldehyde derivative, polyvalent metallic ion complex precursors, phthalic acid imide derivative precursors, phosphoric acid amide derivative precursors, sugar amine reaction product precursors, and urethane type precursors. These precursors of the aromatic primary amine color developing agents are disclosed, for example, in U.S. Pat. Nos. 3,342,599, 2,507,114 2,695,234 and 3,719,492, British Pat. No. 803,783, Japanese Patent O.P.I. Publication Nos. 185628/1978 and 79035/1979, and Research Disclosures Nos. 15159, 12146 and 13924.

These aromatic primary amine color developing agents or the precursors thereof are required to be added in such an amount that a sufficient color development can be achieved only with the amount. This amount may considerably range depending on the type of light-sensitive materials, but, approximately, they may be used in the range of 0.1 mole to 5 moles, preferably 0.5 mole to 3 moles, per mole of silver halide. These color developing agents or the precursors thereof may be used alone or in combination. In order to incorporate them into a light-sensitive material, they can be added by dissolving them in a suitable solvent such as water, methanol, ethanol and acetone, can be added as an emulsification dispersion formed by using a high boiling organic solvent such as dibutyl phthalate, dioctyl phthalate and tricrezyl phosphate, or can be added by impregnating a latex polymer with them as disclosed in Research Disclosure No. 14850.

The light-sensitive silver halide photographic material of the present invention is subjected to bleaching and fixing after color developing. The bleaching may be carried out at the same time with the fixing. As a bleaching agent, there may be used various compounds, among which compounds of polyvalent metals such as iron (III) , cobalt (III) and copper (II), particularly, complex salts of cations of these polyvalent metals with organic acids, for example, metal complex salts of aminopolycarboxylic acid such as ethylenediaminetetraacetic acid, nitrylotriacetic acid and n-hydroxyethyl ethylenediaminediacetic acid, malonic acid, tartaric acid, malic acid, diglycolic acid, dithioglycolic acid, etc., or ferricyanates, bichromate, etc. may be used alone or in combination.

As a fixing agent, there may be used a soluble complexing agent capable of solubilizing a silver halide as a complex salt. This soluble complexing agent may include, for example, sodium thiosulfate, ammonium thiosulfate, potassium thiocyanate, thiourea, thioether, etc.

After the fixing, washing with water is usually carried out. In place of the washing with water, stablilizing may be carried out, or both of them may be carried out in combination. A stabilizing solution used in the stabilizing may contain pH adjusters, chelating agents, mildewproofing agents, etc. Specific conditions for these are available by making reference to Japanese Patent O.P.I. Publication No. 134636/1983, etc.

The present invention can achieve excellent light place preservation of the dye image obtained, is feasible for the rapid processing as the graduation of the same level as in ordinary processing can be attained in the rapid processing, and, also in respect of the variation of developing conditions, can be epoch-making as having superior BF contamination resistence and pH variation resistance. Also, it can not be expected from any prior arts that the cooperative effect of the gold compound and Compound (S) of the present invention can greatly contribute the above effect.

EXAMPLES

Examples of the present invention will be described below in detail, but the embodiments of the present invention are by no means limited to these.

EXAMPLE 1

Preparation of Silver Halide Emulsions: <EM-1>

An aqueous solution of silver nitrate and an aqueous solution of sodium chloride were added and mixed with stirring in an aqueous solution of inert gelatin according to a double jet method. Here, conditions were controlled to keep the temperature of 60° C. and the pH of 3.0 and pAg of 7.8. Subsequently, desalting was carried out according to a conventional method to obtain EM-1. The EM-1 was a monodisperse emulsion comprising cubic silver chloride grains having an average grain size of 0.5 μm.

<EM-2>

An aqueous solution of silver nitrate and an aqueous solution comprising potassium bromide and sodium chloride were added and mixed with stirring in an aqueous solution of inert gelatin according to a double jet method. Here, conditions were controlled to keep the temperature of 60° C. and the pH of 3.0 and pAg of 7.8 following the procedures disclosed in Japanese Patent O.P.I. Publication No. 45437/1984. Subsequently, desalting was carried out according to a conventional method to obtain EM-2.

The EM-2 was a monodisperse emulsion comprising cubic silver chlorobromide grains containing 1.5 mole % of silver bromide as the silver halide composition and having an average size of 0.5 μm.

<EM-3>

In the same manner as for EM-2, preparred was EM-3 which was a monodisperse emulsion comprising tetrahedral silver chlorobromide grains containing 90 mole % of silver bromide as the silver halide composition and having an average grain size of 0.5 μm.

Subsequently, using EM-1 to EM-3, chemical ripening was carried out according to the procedures shown below to prepare EM-4 to EM-23.

Sodium thiosulfate in an amount of 2 mg per mole of silver halide, and the gold compound and Compound (S) as shown in Table 1 were added at 60° C. The gold compound, however, was added 60 minutes after the addition of sodium thiosulfate, and Compound (S), 10 minutes after the addition of the gold compound. Compound (S) was added in an amount of $2\times10^{-3}$ mole per mole of silver halide.

Next, using the high boiling organic solvent as shown in Table 2*a*, and also using the coupler dispersion prepared according to the procedures shown below and the above EM-4 to EM-23, respectively, the emulsion was coated on a polyethylene-coated paper to have a coated silver amount of 0.4 g/m$^2$ in terms of metallic silver, a coupler amount of 0.9 g/m$^2$ and a gelatin amount of 2.0 g/m$^2$. Gelatin was further coated thereon as a protective layer in an amount of 3.0 g/m$^2$.

Method of Dispersing Coupler

In a mixed solvent comprising 10 ml of the high boiling organic solvent and ethyl acetate, 40 g of coupler (YC-1) were dissolved, and the solution obtained was added in an aqueous gelatin solution containing sodium dodecylbenzenesulfonate, followed by dispersion by use of an ultrasonic homogenizer.

YC-1:

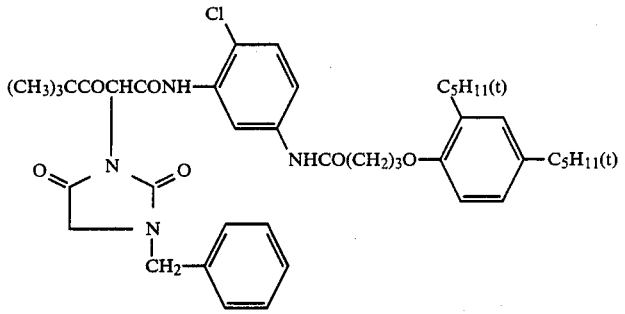

On Sample 1-1 to Sample 1-30 thus obtained, rapid processing performance tests, BF contamination resistance tests, pH variation resistance tests and light place preservation tests were carried out according to the procedures shown below.

Rapid Processing Performance Test

Using a sensitometer (KS-7 type; available from Konishiroku Photo Industry Co., LtD. ), optical wedge exposure was carried out by white light, followed by processing of the following processing step (A) and processing step (B).

Here, processing step (A) is an ordinary processing, and processing step (B) is a rapid processing.

[Processing step (A)]

| | Processing time | Temperature |
|---|---|---|
| Color developing: | 3.5 min | 33° C. |
| Bleach-fixing: | 1.5 min | 33° C. |
| Washing: | 3 min | 33° C. |
| Drying: | — | 80° C. |

[Composition of color developing solution (A)]

| | |
|---|---|
| Pure water | 700 ml |
| Benzyl alcohol | 15 ml |
| Diethylene glycol | 15 ml |
| Hydroxylamine sulfate | 2 g |
| N-ethyl-Nβ-methanesulfonamidoethyl-3-methyl-4-aminoaniline sulfate | 4.5 g |
| Potassium carbonate | 30 g |
| Potassium bromide | 0.4 g |
| Potassium chloride | 0.5 g |
| Potassium sulfite | 2 g |
| Made up to 1 lit by adding pure water (pH = 10.2) | |

[Composition of bleach-fixing solution (A)]

| | |
|---|---|
| Ethylenediaminetetraacetic acid ferric ammonium | 61 g |
| Ethylenediaminetetraacetic acid diammonium | 3 g |
| Ammonium thiosulfate | 125 g |
| Sodium metabisulfite | 13 g |
| Sodium sulfite | 2.7 g |
| Made up to 1 lit by adding Water (pH = 7.2) | |

[Processing step (B)]

| | Temperature | Time |
|---|---|---|
| Color developing | 34.7 ± 0.3° C. | 45 sec |
| Beach-fixing | 34.7 ± 0.5° C. | 45 sec |
| Stabilizing | 30 to 34° C | 90 sec |
| Drying | 60 to 80° C | 60 sec |

[Color developing solution (B)]

| | |
|---|---|
| Pure Water | 800 ml |
| Ethylene glycol | 15 ml |
| N,N-diethylhydroxylamine | 10 g |
| Potassium chloride | 2 g |
| N-ethyl-N-β-methanesulfonamidoethyl-3-methyl-4-aminoaniline sulfate | 5 g |
| Sodium tetrapolyphosphate | 2 g |
| Potassium carbonate | 30 g |
| Brightening agent (a 4,4'-diaminostylbene disulfonic acid derivative) | 1 g |
| Made up to 1 lit as a whole by adding water, and adjusted to pH 10.08. | |

-continued

[Bleach-fixing solution (B)]

| | |
|---|---|
| Ethylenediaminetetraacetic acid ferric ammonium dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| Adjusted to pH 7.1 with use of potassium carbonate or glacial acetic acid, and made up to 1 lit as a whole by adding water. | |

[Stabilizing solution (B)]

| | |
|---|---|
| 5-Chloro-2-methyl-4-isothiazolin-3-on | 1 g |
| 1-Hydroxyethylidene-1,1-diphosphonic acid | 2 g |

Made up to 1 lit by adding water, and ajusted to ph 7.0 with use of sulfuric acid or potassium hydroxide.

On the samples obtained, reflection density was measured with use of a densitometer (PDA-65; available from Konishiroku Photo Industry, Co., Ltd.) to find γ in respect of processing steps (A) and (B). Results are shown in Table 2*b*. Here, the γ represents the inclinatio of a straight line connecting the density 0.5 and 1.5 in the characteristic curve. In Table 2*b*, the smaller the difference between the value of γ in processing step (B) and the value of γ in processing step (A) is, the better the rapid processing performance is judged to have been achieved.

BF Contamination Resistance Test

Prepared was a color developing solution to which 1.0 ml of the above bleach-fixing solution (B) was added to 1 lit. of the above color developing solution (B).

Using this color developing solution, processing was carried out according to the above processing step (B), and the density was measured. Results are shown in Table 2*b*. In the table, Δγ is a value showing the variation width observed when processed with the developing solution in which the bleach-fixing solution was mixed, on the basis of the gradation (γ) observed when processed with a developing solution in which no bleach-fixing solution was mixed. The smaller this value is, the better the BF contamination resistance is.

Here, the γ representing the gradation has the same meaning as in the case of the above rapid processing performance test.

pH Variation Resistance Test

With the same composition as the above color developing solution (B), prepared were color developing solutions adjusted to pH=9.8 and 10.6, respectively.

Using these color developing solutions, processing was carried out according to color developing step (B), and the density was measured.

Results are shown in Table 2*b*. In the table, $\Delta\gamma$ is a value showing the variation width observed when processed with the developing solution of pH=10.6, on the basis of the gradation ($\gamma$) observed when processed with the developing solution of pH=9.8. The smaller this value is, the better the pH variation resistance is.

Here, the $\gamma$ representing the gradation has the same meaning as in the case of the above rapid processing performance test.

Light Place Preservation Test

The value was expressed in terms of the retention of the initial density $D_O=1.0$ of a color image when irradiated with sunlight for 20 days using an under glass weathering stand.

$$\text{Retention}=(D/D_O)\times 100\ (D=\text{density after color fading})$$

Results are shown in Table 2*b*.

TABLE 1

| Chemically sensitized emulsion | Chemically unsensitized emulsion | silver chloride content | Gold compound mol/molAgX) | Compound (S) |
|---|---|---|---|---|
| EM-4 | EM-1 | 100 | — | SC-1 |
| EM-5 | EM-1 | 100 | — | S-6 |
| EM-6 | EM-1 | 100 | — | S-49 |
| EM-7 | EM-1 | 100 | — | S-60 |
| EM-8 | EM-1 | 100 | Chloroaurate ($5\times10^{-5}$) | SC-1 |
| EM-9 | EM-1 | 100 | Chloroaurate ($5\times10^{-5}$) | SC-6 |
| EM-10 | EM-1 | 100 | Chloroaurate ($5\times10^{-5}$) | S-49 |
| EM-11 | EM-1 | 100 | Chloroaurate ($5\times10^{-5}$) | S-60 |
| EM-12 | EM-2 | 98.5 | — | SC-1 |
| EM-13 | EM-2 | 98.5 | — | C-6 |
| EM-14 | EM-2 | 98.5 | — | C-49 |
| EM-15 | EM-2 | 98.5 | — | C-60 |
| EM-16 | EM-2 | 98.5 | Chloroaurate ($5\times10^{-5}$) | SC-1 |
| EM-17 | EM-2 | 98.5 | Chloroaurate ($5\times10^{-5}$) | S-6 |
| EM-18 | EM-2 | 98.5 | Chloroaurate ($5\times10^{-5}$) | S-49 |
| EM-19 | EM-2 | 98.5 | Chloroaurate ($5\times10^{-5}$) | S-60 |
| EM-20 | EM-3 | 10 | Chloroaurate ($5\times10^{-5}$) | SC-1 |
| EM-21 | EM-3 | 10 | Chloroaurate ($5\times10^{-5}$) | S-6 |
| EM-22 | EM-3 | 10 | Chloroaurate ($5\times10^{-5}$) | S-49 |
| EM-23 | EM-3 | 10 | Chloroaurate ($5\times10^{-5}$) | S-60 |

Comparative compound (SC-1):

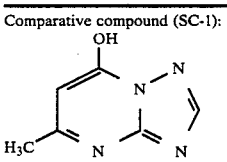

TABLE 2a

| Sample | halide emulsion | Silver Silver ride content (mole % | chloaurate (mol/molAgX) | Chloro-Compound (S) | High boiling organic solvent Comp. No. | Dielectric constant |
|---|---|---|---|---|---|---|
| 1-1 (X) | EM-4 | 100 | — | SC-1 | H-6 | 4.6 |
| 1-2 (X) | EM-4 | 100 | — | SC-1 | H-12 | 5.1 |
| 1-3 (X) | EM-4 | 100 | — | SC-1 | DBP* | 6.4 |
| 1-4 (X) | EM-4 | 100 | — | SC-1 | TCP** | 6.9 |
| 1-5 (X) | EM-5 | 100 | — | S-6 | H-6 | 4.6 |
| 1-6 (X) | EM-5 | 100 | — | S-6 | H-12 | 5.1 |
| 1-7 (X) | EM-6 | 100 | — | S-49 | H-6 | 4.6 |
| 1-8 (X) | EM-6 | 100 | — | S-49 | H-12 | 5.1 |
| 1-9 (X) | EM-7 | 100 | — | S-60 | H-6 | 4.6 |
| 1-10 (X) | EM-7 | 100 | — | S-60 | H-12 | 5.1 |

TABLE 2a-continued

| Sample | halide emulsion | Silver Silver ride content (mole % | chloaurate (mol/molAgX) | Chloro-Compound (S) | High boiling organic solvent Comp. No. | Dielectric constant |
|---|---|---|---|---|---|---|
| 1-11 (X) | EM-8 | 100 | $5\times10^{-5}$ | SC-1 | H-6 | 4.6 |
| 1-12 (X) | EM-8 | 100 | $5\times10^{-5}$ | SC-1 | H-12 | 5.1 |
| 1-13 (Y) | EM-9 | 100 | $5\times10^{-5}$ | S-6 | H-6 | 4.6 |
| 1-14(Y) | EM-9 | 100 | $5\times10^{-5}$ | S-6 | H-12 | 5.1 |
| 1-15(Y) | EM-10 | 100 | $5\times10^{-5}$ | S-49 | H-6 | 4.6 |
| 1-16(Y) | EM-10 | 100 | $5\times10^{-5}$ | S-49 | H-12 | 5.1 |
| 1-17(Y) | EM-11 | 100 | $5\times10^{-5}$ | S-60 | H-6 | 4.6 |
| 1-18(Y) | EM-11 | 100 | $5\times10^{-5}$ | S-60 | H-12 | 5.1 |
| 1-19(X) | EM-12 | 98.5 | — | SC-1 | H-6 | 4.6 |
| 1-20(X) | EM-13 | 98.5 | — | S-6 | H-6 | 4.6 |
| 1-21(X) | EM-14 | 98.5 | — | S-49 | H-6 | 4.6 |
| 1-22(X) | EM-15 | 98.5 | — | S-60 | H-6 | 4.6 |
| 1-23(X) | EM-16 | 98.5 | $5\times10^{-5}$ | SC-1 | H-6 | 4.6 |
| 1-24(Y) | EM-17 | 98.5 | $5\times10^{-5}$ | S-6 | H-6 | 4.6 |
| 1-25(Y) | EM-18 | 98.5 | $5\times10^{-5}$ | S-49 | H-6 | 4.6 |
| 1-26(Y) | EM-19 | 98.5 | $5\times10^{-5}$ | S-60 | H-6 | 4.6 |
| 1-27(X) | EM-20 | 10 | $5\times10^{-5}$ | SC-1 | H-6 | 4.6 |
| 1-28(X) | EM-21 | 10 | $5\times10^{-5}$ | S-60 | H-6 | 4.6 |
| 1-29(X) | EM-22 | 10 | $5\times10^{-5}$ | S-49 | H-6 | 4.6 |
| 1-30(X) | EM-23 | 10 | $5\times10^{-5}$ | S-60 | H-6 | 4.6 |

X: Comparative example
Y: Present invention
*DBP: Dibutylphthalate
**TCP: Tricresyl phosphate TABLE 2b

| Sample | Rapid processing feasibility: Processing step (A) | Rapid processing feasibility: Processing step (B) | BF inclusion resistance ($\Delta\gamma$) | pH variation resistance ($\Delta\gamma$) | Light place preservation* |
|---|---|---|---|---|---|
| 1-1 | 3.20 | 2.53 | 0.95 | 0.61 | 76 |
| 1-2 | 3.25 | 2.62 | 0.98 | 0.58 | 77 |
| 1-3 | 3.18 | 3.15 | 0.75 | 0.51 | 53 |
| 1-4 | 3.22 | 3.20 | 0.72 | 0.47 | 51 |
| 1-5 | 3.16 | 2.61 | 0.70 | 0.49 | 78 |
| 1-6 | 3.18 | 2.65 | 0.69 | 0.55 | 76 |
| 1-7 | 3.23 | 2.85 | 0.89 | 0.41 | 76 |
| 1-8 | 3.20 | 2.77 | 0.82 | 0.39 | 75 |
| 1-9 | 3.19 | 2.70 | 0.67 | 0.38 | 77 |
| 1-10 | 3.20 | 2.76 | 0.63 | 0.27 | 77 |
| 1-11 | 3.12 | 2.50 | 0.85 | 0.48 | 78 |
| 1-12 | 3.08 | 2.55 | 0.83 | 0.52 | 76 |
| 1-13 | 3.20 | 3.18 | 0.23 | 0.25 | 77 |
| 1-14 | 3.23 | 3.20 | 0.28 | 0.22 | 78 |
| 1-15 | 3.18 | 3.09 | 0.37 | 0.19 | 75 |
| 1-16 | 3.15 | 3.15 | 0.33 | 0.17 | 76 |
| 1-17 | 3.17 | 3.15 | 0.23 | 0.18 | 78 |
| 1-18 | 3.20 | 3.18 | 0.25 | 0.16 | 76 |
| 1-19 | 3.23 | 2.53 | 0.92 | 0.55 | 77 |
| 1-20 | 3.21 | 2.70 | 0.68 | 0.53 | 77 |
| 1-21 | 3.18 | 2.75 | 0.77 | 0.38 | 78 |
| 1-22 | 3.21 | 2.77 | 0.72 | 0.35 | 75 |
| 1-23 | 3.20 | 2.65 | 0.85 | 0.45 | 77 |
| 1-24 | 3.21 | 3.20 | 0.15 | 0.22 | 76 |
| 1-25 | 3.23 | 3.18 | 0.25 | 0.13 | 76 |
| 1-26 | 3.20 | 3.21 | 0.22 | 0.12 | 79 |
| 1-27 | 3.20 | 2.13 | 1.10 | 0.73 | 78 |
| 1-28 | 3.23 | 1.85 | 0.85 | 0.65 | 78 |
| 1-29 | 3.23 | 1.90 | 0.95 | 0.48 | 78 |
| 1-30 | 3.24 | 1.91 | 0.93 | 0.52 | 79 |

*: For 20 days under sunlight

It is seen from Tables 2*a* and 2*b* that;

(1) Samples 1-3 and 1-4 employing hig boiling solvents having the dielectric constant of more than 6 can achieve only very poor light place preservation;

(2) Samples 1-27 to 1-30 employing emulsions containing silver halide grains having low silver chloride content can not achieve sufficient gradation under the rapid processing condition as used in the present Example, and can not show good processing stability; and (3) the samples showing superior rapid processing performance while achieving excellent image preservation, and also showing good processing stability for BF contamination resistance and pH variation resistance are obtained only by the contamination of all of the high boiling organic solvent, silver halide emulsion having high silver chloride content and prepared by using the gold compound, and Compound (S) according to the present invention.

Making review in greater detail, it is seen that Samples 1-24 to 1-26 containing a trace amount of silver bromide show particularly improved rapid processing performance and processing stability.

Accordingly, it is understood that the effect of the present invention is unique effect that can be obtained only by the constitution of the present invention, whereby both the image preservation and rapid processing feasibility (including processing stability) can be achieved.

EXAMPLE 2

Preparation of EM-24 to EM-57

Chemical ripening was carried out on EM-1 prepared in Example 1 in the same manner as in Example 1, provided that chloroaurate, Compound (S) and comparative compound SC-2 were used as shown in Table 3*a*.

Preparation Of Cyan Coupler Dispersion

A cyan coupler dispersion was prepared in the same manner as in the case of the yellow coupler dispersion in Example 1, except that CC-1 was used as a cyan dye-forming coupler and H-2 was used as the high boiling organic solvent.

CC-1

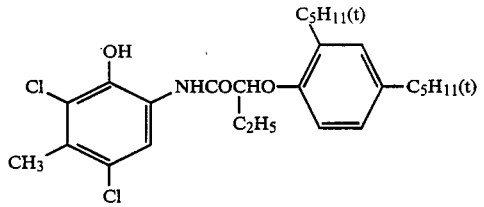

Subsequently, using the above EM-24 to EM-57 and cyan coupler dispersion, Samples 2-1 to 2-34 were produced in the same procedures as in Example 1, provided that the coupler coating amount was altered to 4.8 g/m$^2$.

The rapid processing performance and processing stability (BF contamination resistance and pH variation resistance) were tested on Samples 2-1 to 2-34 thus obtained in the same manner as in Example I. Results are shown in Table 3*b*.

TABLE 3a

| Sample | Silver halide emulsion | Silver chloride content (mole %) | Chloroaurate (mol/molAgX) | Compound (S) | High boiling organic solvent: Comp. No. | High boiling organic solvent: Dielectric constant |
|---|---|---|---|---|---|---|
| 2-1(X) | EM-24 | 98.5 | — | SC-2 | H-2 | 5.3 |
| 2-2(X) | EM-25 | 98.5 | $3 \times 10^{-5}$ | SC-2 | H-2 | 5.3 |
| 2-3(X) | EM-26 | 98.5 | — | S-1 | H-2 | 5.3 |
| 2-4(Y) | EM-27 | 98.5 | $3 \times 10^{-5}$ | S-1 | H-2 | 5.3 |

TABLE 3a-continued

| Sample | Silver halide emulsion | Silver chloride content (mole %) | Chloroaurate (mol/molAgX) | Compound (S) | High boiling organic solvent: Comp. No. | High boiling organic solvent: Dielectric constant |
|---|---|---|---|---|---|---|
| 2-5(Y) | EM-28 | 98.5 | $3 \times 10^{-5}$ | S-2 | H-2 | 5.3 |
| 2-6(Y) | EM-29 | 98.5 | $3 \times 10^{-5}$ | S-9 | H-2 | 5.3 |
| 2-7(Y) | EM-30 | 98.5 | $3 \times 10^{-5}$ | S-10 | H-2 | 5.3 |
| 2-8(Y) | EM-31 | 98.5 | $3 \times 10^{-5}$ | S-12 | H-2 | 5.3 |
| 2-9(Y) | EM-32 | 98.5 | $3 \times 10^{-5}$ | S-13 | H-2 | 5.3 |
| 2-10(Y) | EM-33 | 98.5 | $3 \times 10^{-5}$ | S-15 | H-2 | 5.3 |
| 2-11(Y) | EM-34 | 98.5 | $3 \times 10^{-5}$ | S-19 | H-2 | 5.3 |
| 2-12(Y) | EM-35 | 98.5 | $3 \times 10^{-5}$ | S-21 | H-2 | 5.3 |
| 2-13(Y) | EM-36 | 98.5 | $3 \times 10^{-5}$ | S-29 | H-2 | 5.3 |
| 2-14(Y) | EM-37 | 98.5 | $3 \times 10^{-5}$ | S-33 | H-2 | 5.3 |
| 2-15(Y) | EM-38 | 98.5 | $3 \times 10^{-5}$ | S-37 | H-2 | 5.3 |
| 2-16(Y) | EM-39 | 98.5 | $3 \times 10^{-5}$ | S-41 | H-2 | 5.3 |
| 2-17(Y) | EM-40 | 98.5 | $3 \times 10^{-5}$ | S-42 | H-2 | 5.3 |
| 2-18(Y) | EM-41 | 98.5 | $3 \times 10^{-5}$ | S-43 | H-2 | 5.3 |
| 2-19(Y) | EM-42 | 98.5 | $3 \times 10^{-5}$ | S-47 | H-2 | 5.3 |
| 2-20(Y) | EM-43 | 98.5 | $3 \times 10^{-5}$ | S-48 | H-2 | 5.3 |
| 2-21(Y) | EM-44 | 98.5 | $3 \times 10^{-5}$ | S-49 | H-2 | 5.3 |
| 2-22(Y) | EM-45 | 98.5 | $3 \times 10^{-5}$ | S-51 | H-2 | 5.3 |
| 2-23(Y) | EM-46 | 98.5 | $3 \times 10^{-5}$ | S-52 | H-2 | 5.3 |
| 2-24(Y) | EM-47 | 98.5 | $3 \times 10^{-5}$ | S-54 | H-2 | 5.3 |
| 2-25(Y) | EM-48 | 98.5 | $3 \times 10^{-5}$ | S-55 | H-2 | 5.3 |
| 2-26(Y) | EM-49 | 98.5 | $3 \times 10^{-5}$ | S-56 | H-2 | 5.3 |
| 2-27(Y) | EM-50 | 98.5 | $3 \times 10^{-5}$ | S-58 | H-2 | 5.3 |
| 2-28(Y) | EM-51 | 98.5 | $3 \times 10^{-5}$ | S-59 | H-2 | 5.3 |
| 2-29(Y) | EM-52 | 98.5 | $3 \times 10^{-5}$ | S-61 | H-2 | 5.3 |
| 2-30(Y) | EM-53 | 98.5 | $3 \times 10^{-5}$ | S-64 | H-2 | 5.3 |
| 2-31(Y) | EM-54 | 98.5 | $3 \times 10^{-5}$ | S-65 | H-2 | 5.3 |
| 2-32(Y) | EM-55 | 98.5 | $3 \times 10^{-5}$ | S-67 | H-2 | 5.3 |
| 2-33(Y) | EM-56 | 98.5 | $3 \times 10^{-5}$ | S-68 | H-2 | 5.3 |
| 2-34(Y) | EM-57 | 98.5 | $3 \times 10^{-5}$ | S-1/S-49* | H-2 | 5.3 |

Y: Comparative example
X: Present invention
SC-2:

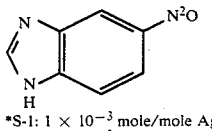

*S-1: $1 \times 10^{-3}$ mole/mole AgX
S-49: $1 \times 10^{-3}$ mole/mole AgX

It is seen from Tables 3*a* and 3*b* that Samples 2-4 to 2-34 in which the gold compound and compound (S) were used in the emulsion of the present invention having high silver chloride content are all excellent in the rapid processing performance and processing stability for BF contamination resistance and pH variation resistance. Making review in detail on Compound (S), it is seen that the compound included in the compound of General Formula (SA), wherein Z represents —N—$R_{A1}$ or an oxygen atom, and the compound represented by General Formula (SB) show particularly good BF contamination resistance, and the compound of General Formula (SB) shows particularly good pH variation resistance. As for the light place preservation, although not contained in the data, there can be achieved excellent preservation since the high boiling organic solvent according to the present invention is used.

EXAMPLE 3

On EM-2 prepared in Example 1, chemical ripening (including spectral sensitization) was carried out at 60° C. by using 1.8 mg of sodium thiosulfate per mole of silver halide, sensitizing dyes, chloroaurate, and Compound (S) or comparative compound (SC-1) as shown in Table 4 to prepare EM-58 to EM-69.

Next, couplers YC-1, MC-1 and CC-1 were respectively dissolved in H-6 or DBP to have the content as shown in Table 5, to prepare 6 kinds of coupler dispersions.

TABLE 4

| Emulsion | Sensitizing dye | mg/molAgX | Chloroaurate (mol/molAgX) | Compound (S) (mol/molAgX) |
|---|---|---|---|---|
| EM-58 | D-1 | 120 | — | SC-1 ($2 \times 10^{-3}$) |
| EM-59 | D-1 | 120 | — | S-6 ($2 \times 10^{-3}$) |
| EM-60 | D-1 | 120 | $1 \times 10^{-5}$ | S-6 ($2 \times 10^{-3}$) |
| EM-61 | D-1 | 120 | $1 \times 10^{-5}$ | S-6 ($5 \times 10^{-4}$) |
| EM-62 | D-2 | 150 | — | SC-2 ($2 \times 10^{-3}$) |
| EM-63 | D-2 | 150 | — | S-6 ($2 \times 10^{-3}$) |
| EM-64 | D-2 | 150 | $6 \times 10^{-5}$ | S-6 ($2 \times 10^{-3}$) |
| EM-65 | D-2 | 150 | $6 \times 10^{-5}$ | S-6 ($5 \times 10^{-4}$) |
| EM-66 | D-3 | 40 | — | SC-1 ($2 \times 10^{-3}$) |
| EM-67 | D-3 | 40 | — | S-6 ($2 \times 10^{-3}$) |
| EM-68 | D-3 | 40 | $3 \times 10^{-5}$ | S-6 ($2 \times 10^{-3}$) |
| EM-69 | D-3 | 40 | — | S-6 ($5 \times 10^{-4}$) |

D-1:

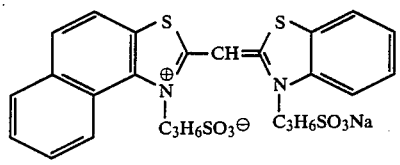

D-2:

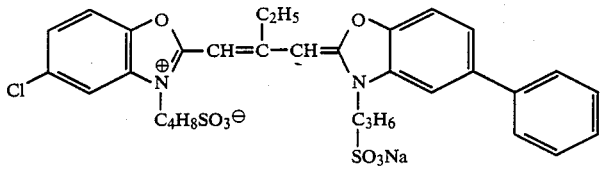

D-3:

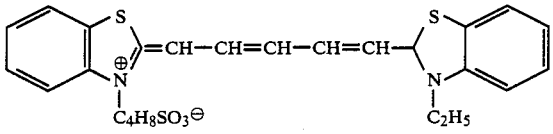

MC-1:

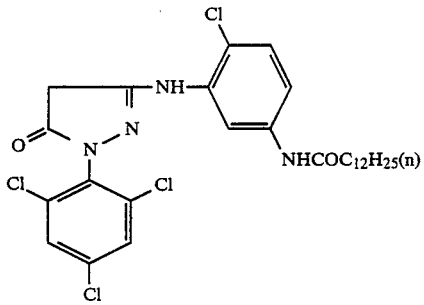

Next, the above emulsions and coupler dispersions were used in the combination as shown in Table 6*a* to produce Samples 3-1 to 3-9 having the constitution as shown in Table 5.

As to the hardening agent, bis(vinylsulfonylmethyl) ether was used in respect of Samples 3-1 and 3-4, and exemplary hardening agent HD-2, in respect of Samples 3-5 to 3-9. In respect of Sample 3-9, it was added to the second layer and the fourth layer in the amount that may give a coating amount of $1.5 \times 10^{-5}$ mole/m$^2$, respectively.

TABLE 5

| Layer | Constitution |
|---|---|
| Seventh layer | Gelatin (1.0 g/m$^2$) |
| Sixth layer | Ultraviolet absorbent (UV-1, 0.3 g/m$^2$)<br>Gelatin (0.7 g/m$^2$) |
| Fifth layer | Red-sensitive silver chlorobromide emulsion (coated silver amount 0.25 g/m$^2$)<br>Cyan coupler (CC-1, 0.3 g/m$^2$)<br>High boiling organic solvent (0.2 g/m$^2$)<br>Gelatin (1.0 g/m$^2$) |
| Fourth layer | Ultraviolet absorbent (UV-1, 0.7 g/m$^2$)<br>Gelatin (1.3 g/m$^2$) |
| Third layer | Green-sensitive silver chlorobromide emulsion (coated silver amount, 0.18 g/m$^2$)<br>Magenta coupler (MC-1, 0.4 g/m$^2$)<br>High boiling organic solvent (0.2 g/m$^2$)<br>Gelatin (1.5 g/m$^2$) |
| Second layer | Gelatin (1.0 g/m$^2$) |
| First layer | Blue-sensitive silver chlorobromide emulsion (coated silver amount, 0.40 g/m$^2$)<br>Yellow coupler (YC-1, 0.9 g/m$^2$)<br>High boiling organic solvent (0.03 g/m$^2$)<br>Gelatin (2.0 g/m$^2$) |
| Support | Polyethylene coated paper |

TABLE 5-continued

| Layer | Constitution |
|---|---|
| (UV-1): | 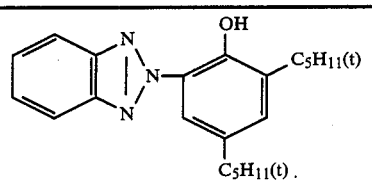 |

On Samples 3-1 to 3-9 thus obtained, tests for rapid processing performance, processing stability and light place preservation were carried out in the same manner as in Example 1. Results are shown in Tables 6*b* and 6*c*, wherein the rapid processing performance was shown as difference ($\Delta\gamma$) in the $\gamma$ between the processing steps (A) and (B). The larger the $\Delta\gamma$ is, the poorer the rapid processing performance is judged to be.

TABLE 6a

| Sample | Silver halide emulsion 1st layer | 3rd layer | 5th layer | High boling organic solvent Yellow coupler | Magenta coupler | Cyan coupler | Hardening agent |
|---|---|---|---|---|---|---|---|
| 3-1(X) | EM-58 | EM-62 | EM-66 | DBP | DBP | DBP | CHD* |
| 3-2(X) | EM-58 | EM-62 | EM-66 | H-6 | H-6 | H-6 | CHD* |
| 3-3(X) | EM-59 | EM-63 | EM-67 | H-6 | H-6 | H-6 | CHD* |
| 3-4(Y) | EM-60 | EM-64 | EM-68 | H-6 | H-6 | H-6 | CHD* |
| 3-5(X) | EM-58 | EM-62 | EM-69 | DBP | DBP | DBP | HD-2 |
| 3-6(X) | EM-58 | EM-62 | EM-69 | H-6 | H-6 | H-6 | HD-2 |
| 3-7(X) | EM-59 | EM-63 | EM-67 | DBP | DBP | DBP | HD-2 |
| 3-8(Y) | EM-60 | EM-64 | EM-68 | H-6 | H-6 | H-6 | HD-2 |
| 3-9(Y) | EM-61 | EM-65 | EM-69 | H-6 | H-6 | H-6 | HD-2 |

X: Comparative example
Y: Present invention
*CHD: Comparative hardening agent: bis(vinylsulfonyl)ether TABLE 6b

| Sample | Rapid processing performance ($\Delta\gamma$) Y | M | C | BF contamination resistance ($\Delta\gamma$) Y | M | C |
|---|---|---|---|---|---|---|
| 3-1 | 0.10 | 0.08 | 0.09 | 0.27 | 0.33 | 0.31 |
| 3-2 | 0.75 | 0.38 | 0.48 | 0.75 | 0.95 | 0.92 |
| 3-3 | 0.56 | 0.32 | 0.39 | 0.62 | 0.80 | 0.78 |
| 3-4 | 0.18 | 0.07 | 0.12 | 0.22 | 0.28 | 0.25 |
| 3-5 | 0.21 | 0.10 | 0.16 | 0.61 | 0.90 | 0.88 |
| 3-6 | 0.73 | 0.35 | 0.45 | 0.25 | 0.30 | 0.32 |
| 3-7 | 0.55 | 0.30 | 0.33 | 0.53 | 0.77 | 0.75 |
| 3-8 | 0.05 | 0.03 | 0.05 | 0.14 | 0.12 | 0.14 |
| 3-9 | 0.07 | 0.04 | 0.06 | 0.15 | 0.13 | 0.16 |

TABLE 6c

| Sample | pH variation resistance ($\Delta\gamma$) Y | M | C | Light place preservation (Retension (%)) Y | M | C |
|---|---|---|---|---|---|---|
| 3-1 | 0.21 | 0.23 | 0.27 | 53 | 65 | 61 |
| 3-2 | 0.35 | 0.38 | 0.42 | 78 | 82 | 77 |
| 3-3 | 0.32 | 0.31 | 0.33 | 77 | 84 | 75 |
| 3-4 | 0.20 | 0.19 | 0.25 | 78 | 83 | 76 |
| 3-5 | 0.19 | 0.23 | 0.22 | 55 | 63 | 61 |
| 3-6 | 0.32 | 0.36 | 0.37 | 76 | 82 | 78 |
| 3-7 | 0.27 | 0.28 | 0.32 | 78 | 83 | 77 |
| 3-8 | 0.12 | 0.10 | 0.11 | 79 | 83 | 78 |
| 3-9 | 0.12 | 0.09 | 0.12 | 78 | 84 | 78 |

It is seen from Table 6 that, even in the multilayer system as in the present Example, a light-sensitive material excellent in the rapid processing performance, procession stability for BF contamination resistance and pH variation resistance, and dye image preservation can be obtained only in the constitution of the present invention in the same manner as in Examples 1 and 2. It is also seen that the trichlorotriazine type compound represented by General Formula (HDA) or (HDB) is preferably used as a hardening agent, and that Compound (S) can exhibit similar effect even when added to a photographic layer contiguous to an emulsion layer.

EXAMPLE-4

PREPARATION OF EM-70

Aqueous silver nitrate solution and aqueous halide solution containing both potassium bromide and sodium chloride were stirred in an inert gelatin aqueous solution by means of a double-jet method and thereby were mixed. In this case, the conditions for aforesaid mixing were under control according to the method described in Japanese Patent Publication Open to Public Inspection No. 45437/1984 to keep the temperature of 50° C., pH of 5.5 and pAg of 7.5. Then the mixture was desalted through an ordinary method and washed, thus EM-70 was obtained.

This EM-70 is a monodispersed emulsion having an average grain size of 0.4 $\mu$m and a silver halide composition consisting of cubic silver chlorobromide grains containing 0.3 mol % of silver bromide.

PREPARATION OF EM-71 THROUGH EM-78

EM-70 was subjected to the chemical ripening at a temperature of 60° C. by the use of sodium thiosulfate (1 mg per 1 mol of silver halide), sensitizing dye [D-3] (50 mg per 1 mol of silver halide) and chloroauric acid ($3\times10^{-5}$ mol per 1 mol of silver halide) as shown in Table-7 and upon completion of the chemical ripening, S-57 ($1\times10$Y-3H mol per 1 mol of silver halide) was added to prepare red-sensitive emulsions EM-71 through EM-77. EM-78 was further prepared by changing the time for adding chloroauric acid by 30 minutes compared with that for S-57.

TABLE-7

| Emulsion | Time of adding chloroauric acid |
|---|---|
| EM-71 | not added |
| EM-72 | 30 min. before sodium thiosulfate |
| EM-73 | 3 min. before sodium thiosulfate |
| EM-74 | concurrently with sodium thiosulfate |
| EM-75 | 1 min after sodium thiosulfate |
| EM-76 | 30 min after sodium thiosulfate |
| EM-77 | 90 min after sodium thiosulfate |
| EM-78 | 30 min later compared with S-57 |

Each of aforesaid EM-71 through EM-78 was used as a red-sensitive emulsion and Samples 4-1 through 4-8 having an arrangement in Table-8 were prepared. As a red-sensitive emulsion, Sample 4-9 was prepared by the use of EM-71 in the same way as that in Sample 4-1 except that chloroauric acid was added during the preparation of emulsion coating for the 5th layer so that the coating density of $5.6\times10^{-8}$ mol/m$^2$ was obtained.

Samples 4-1 through 4-9 thus obtained were subjected to the evaluation for the rapid processing suitability and the stability for processing in the same method as that in Example-3. In the present Example, however, the density for red light only was measured for the density measurement because the observation was focused on the behavior of the emulsion layer of the 5th layer. The results are shown on Table-9.

TABLE 8

| Layer | Composition |
|---|---|
| 7th layer | Gelatin (1.0 g/m$^2$), HD-2 (0.1 g/m$^2$) |
| 6th layer | UV absorbing agent (UV-1 0.3 g/m$^2$)<br>Gelatin (0.7 g/m$^2$) |
| 5th layer | Red-sensitive silver chlorobromide emulsion<br>(silver coating density 0.20 g/m$^2$)<br>Cyan coupler (C-2 0.3 g/m$^2$)<br>High-boiling organic solvent H-12 (0.2 g/m$^2$)<br>Gelatin (1.0 g/m$^2$) |
| 4th layer | UV absorbing agent (UV-1 0.7 g/m$^2$)<br>Gelatin (1.3 g/m$^2$) |
| 3rd layer | Green-sensitive silver chlorobromide emulsion<br>EM-65 (silver coating density 0.30 g/m$^2$)<br>Magenta coupler (MC-1 0.4 g/m$^2$)<br>High-boiling organic solvent H-12 (0.2 g/m$^2$)<br>Gelatin (1.5 g/m$^2$) |
| 2nd layer | Gelatin (1.0 g/m$^2$) |
| 1st layer | Blue-sensitive silver chlorobromide emulsion<br>EM-61 (silver coating density 0.35 g/m$^2$)<br>Yellow coupler (YC-1 0.9 g/m$^2$)<br>High-boiling organic solvent H-12 (0.03 g/m$^2$)<br>Gelatin (2.0 g/m$^2$)<br>Support Polyethylene resin-coated paper |
| C-2 | 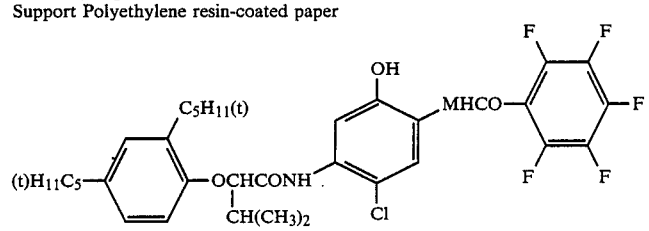 |

TABLE 9

| Sample | Red-sensitive emulsion | When chloroauric acid is to be added | Rapid processing feasibility (Δγ) | BF inclusion resistance (Δγ) | pH variation resistance (Δγ) |
|---|---|---|---|---|---|
| 4-1 (Comparative example) | EM-71 | not added | 0.43 | 0.87 | 0.41 |
| 4-2 (This invention) | EM-72 | 30 min. before sodium thiosulfate | 0.15 | 0.31 | 0.23 |
| 4-3 (This invention) | EM-73 | 5 min. before sodium thiosulfate | 0.08 | 0.21 | 0.19 |
| 4-4 (This invention) | EM-74 | Concurrently with thiosulfate | 0.07 | 0.26 | 0.15 |
| 4-5 (This invention) | | 1 min. after sodium thiosulfate | 0.10 | 0.27 | 0.17 |
| 4-6 (This invention tion) | | 30 min. after sodium thiosulfate | 0.07 | 0.22 | 0.19 |
| 4-7 (This invention) | | 90 min. after sodium thiosulfate | 0.09 | 0.26 | 0.20 |
| 4-8 (This | | 30 min. later compared to S-57 | 0.31 | 0.65 | 0.33 |

TABLE 9-continued

| Sample | Red-sensitive emulsion | When chloroauric acid is to be added | Rapid processing feasibility (Δγ) | BF inclusion resistance (Δγ) | pH variation resistance (Δγ) |
|---|---|---|---|---|---|
| invention) | | | | | |
| 4-9 (This invention) | | During preparation of emulsion coating solution | 0.35 | 0.69 | 0.34 |

Table-9 shows that gold compounds related to the present invention offer their effects when they are added at various timing as shown in Table-9 and further shows that the greater effects are obtained when they are added during the period from the start to the end of chemical ripening.

What is claimed is:

1. A light-sensitive silver halide photographic material comprising a support and, provided thereon, at least one light-sensitive silver halide emulsion layer which contains silver halide grains having silver chloride content of 90 mole % or more and containing a gold compounds, a dye-forming coupler dispersed therein by the use of a high boiling-point organic solvent having a dielectric constant of not more than 6.0 and a compound represented by General Formula [S];

[S]

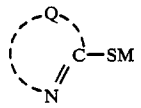

wherein Q is a group of atoms necessary to complete a 5- or 6-membered heterocyclic ring or a 5- or 6-membered ring fused with a benzene ring and M is a hydrogen atom, an alkali metal or an ammonium group.

2. The light-sensitive silver halide photographic material of claim 1, wherein said dye forming coupler is an acyl acetoanilide yellow dye-forming coupler.

3. The light-sensitive silver halide photographic material of claim 1, wherein said dye forming coupler is a 5-pyrazolone-type or a pyrazoloazole-type magenta dye-forming coupler.

4. The light-sensitive silver halide photographic material of claim 1, wherein said dye forming coupler is a phenole-type or a napthole type cyan dye-forming coupler.

5. The light-sensitive silver halide photographic material of claim 1, wherein said high boiling-point organic solvent has a vapor pressure of 0.5 mmHg or less at 100° C.

6. The light-sensitive silver halide photographic material of claim 1, wherein said high boiling-point organic solvent has a dielectric constant of 1.9 to 6.0.

7. The light-sensitive silver halide photographic material of claim 1, wherein said high-boiling point organic solvent is selected from the group consisting of a phthalic acid ester, a phosphoric acid ester, an organic amine, a ketone, and a hydrocarbon compound.

8. The light-sensitive silver halide photographic material of claim 1, wherein said high-boiling point organic solvent is selected from the group consisting of a phthalic acid ester represented by general formula [HA];

[HA]

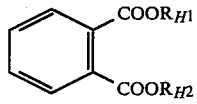

wherein $R_{H1}$ and $R_{H2}$ are independently selected from the group consisting of an alkyl group, an alkenyl group and an aryl group provided that the total number of carbon atoms contained in $R_{H1}$ and $R_{H2}$ is 9 to 32; and a phosphoric acid ester represented by general formula [HB]

[HB]

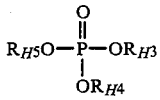

wherein $R_{H3}$, $R_{H4}$ and $R_{H5}$ are independently selected from the group consisting of an alkyl group an alkenyl group and an aryl group provided that the total number of carbon atoms contained in $R_{H3}$, $R_{H4}$ and $R_{H5}$ is 24 to 54.

9. The light-sensitive silver halide photographic material of claim 8, wherein said total number of carbon atoms contained in $R_{H1}$ and $R_{H2}$ is 16 to 24.

10. The light-sensitive silver halide photographic material of claim 1, wherein said silver halide is a silver chlorobromide containing silver bromide at a proportion of not more than 10 mole %.

11. The light-sensitive silver halide photographic material of claim 1, wherein said silver halide contains silver bromide at a proportion of 0.05 to 5 mole %.

12. The light-sensitive silver halide photographic material of claim 1, wherein said 5- or 6-membered heterocyclic ring or said 5- or 6-membered ring fused with a benzene ring is one selected from the group consisting of an imidazole ring, a tetrazole ring, a thiazole ring an oxazole ring, a selenezole ring, a benzimidazole ring, a naphthoimidazole ring, a benzothiazole ring, a naphthothiazole ring, a benzoselenazole ring, a naphthoselenazole ring, a benzoxazole ring, a pyridine and a pyrimidine.

13. The light-sensitive silver halide photographic material of claim 1, wherein said gold compound is selected from the group consisting of auric chloride, potassium chloroaurate, auric trichloride, potassium auric thiocyanate, tetracyanoauric azide, ammonium aurothiocyanate, pyridyltrichlorogold, gold sulfide, and gold selenide.

14. The light-sensitive silver halide photographic material of claim 1, wherein said compound represented by general formula [S] is selected from a compound represented by general formulae [SA], [SB] and [SD];

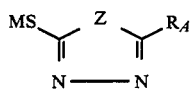

[SA]

wherein Z is selected from a

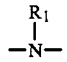

group, oxygen atom or sulfur atom, $R_A$ is selected from the group consisting of a hydrogen atom, an alkyl group, an aryl group, an alkenyl group, a cycloalkyl group, a—$SR_{A1}$ group, a

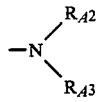

group, —$NHCOR_{A4}$ group, a —$NHSO_2R_{A5}$ group and a heterocyclic ring, $R_{A1}$ is selected from the group consisting of a hydrogen atom, an alkyl group, an alkenyl group, a cycloalkyl group, an aryl group, a —$COR_{A4}$ group and a —$SO_2R_{A5}$ group, $R_{A2}$ and $R_{A3}$ are independently selected from a group consisting of a hydrogen atom, an alkyl group and an aryl group, $R_{A4}$ and $R_{A5}$ are independently selected from the group consisting of an alkyl group and an aryl group and M is a hydrogen atom, an alkali metal or an ammonium group;

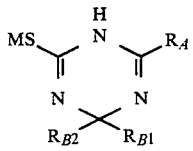

[SB]

wherein $R_A$ is selected from the group consisting of a hydrogen atom, an alkyl group, an aryl group, an alkenyl group, a cycloalkyl group, a —$SR_{A1}$ group, a

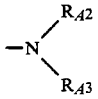

group, —$NHCOR_{A4}$ group, a —$NHSO_2R_{A5}$ group and a heterocyclic ring, $R_{A1}$ is selected from the group consisting of a hydrogen atom, an alkyl group, an alkenyl group, a cycloalkyl group, an aryl group, a —$COR_{A4}$ group and a —$SO_2R_{A5}$ group, $R_{A2}$ and $R_{A3}$ are independently selected from a group consisting of a hydrogen atom, an alkyl group and an aryl group, $R_{A4}$ and $R_{A5}$ are independently selected from the group consisting of an alkyl group and an aryl group and M is a hydrogen atom, an alkali metal or an ammonium group, $R_{B1}$ is selected from the group consisting of a hydrogen atom, an alkyl group, an alkenyl group, a cycloalkyl group, an aryl group, a —$COR_{A4}$ group and a —$SO_2R_{A5}$ group, $R_{B2}$ is selected from a group consisting of a hydrogen atom, an alkyl group and an aryl group; and

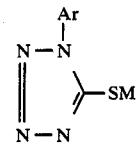

[SD]

wherein Ar is selected from the group consisting of a

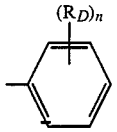

group, a

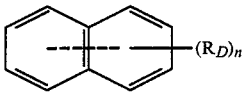

group and a

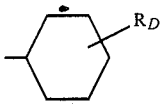

group, in which $R_D$ is selected from the group consisting of an alkyl group, an alkoxy group, a carboxy group or a salt thereof, a sulfo group or a salt thereof, a hydroxy group, an amino group, an acylamino group, a carbamoyl group and a sulfonamide group, n is an integer of 0, 1 and 2, and M is a hydrogen atom, an alkali metal or an ammonium group.

* * * * *